US010993037B2

(12) United States Patent
Miyagawa et al.

(10) Patent No.: US 10,993,037 B2
(45) Date of Patent: Apr. 27, 2021

(54) ACOUSTIC CONVERTER AND SOUND OUTPUT DEVICE

(71) Applicant: SONY CORPORATION, Tokyo (JP)

(72) Inventors: Takehiro Miyagawa, Aichi (JP); Tsutomu Nagumo, Aichi (JP)

(73) Assignee: SONY CORPORATION, Tokyo (JP)

( * ) Notice: Subject to any disclaimer, the term of this patent is extended or adjusted under 35 U.S.C. 154(b) by 335 days.

(21) Appl. No.: 16/066,812

(22) PCT Filed: Nov. 25, 2016

(86) PCT No.: PCT/JP2016/004965
§ 371 (c)(1),
(2) Date: Jun. 28, 2018

(87) PCT Pub. No.: WO2017/125976
PCT Pub. Date: Jul. 27, 2017

(65) Prior Publication Data

US 2020/0275214 A1 Aug. 27, 2020

(30) Foreign Application Priority Data

Jan. 19, 2016 (JP) ..... JP2016-007977

(51) Int. Cl.
*H04R 11/02* (2006.01)
*H04R 7/18* (2006.01)

(52) U.S. Cl.
CPC ..... *H04R 11/02* (2013.01); *H04R 7/18* (2013.01); *H04R 2400/03* (2013.01); *H04R 2400/11* (2013.01)

(58) Field of Classification Search
CPC ..... H04R 11/02; H04R 7/18; H04R 2400/11; H04R 2400/03
See application file for complete search history.

(56) References Cited

U.S. PATENT DOCUMENTS 8,630,439 B2 * 1/2014 Nagumo ..... H04R 11/02 381/395
2006/0083400 A1 * 4/2006 Miller ..... H04R 11/00 381/396
2011/0311088 A1 12/2011 Nagumo et al.

FOREIGN PATENT DOCUMENTS

JP 58-099099 A 6/1983
JP 5899099 A 6/1983
(Continued)

OTHER PUBLICATIONS

International Search Report and Written Opinion of PCT Application No. PCT/JP2016/004965, dated Feb. 7, 2017, 08 pages of ISRWO.

(Continued)

*Primary Examiner* — Brian Ensey
(74) *Attorney, Agent, or Firm* — Chip Law Group

(57) ABSTRACT

A projection-type display apparatus includes a driver unit and a diaphragm unit. The diaphragm unit includes a holding frame that has an opening, a film that is bonded to a film bonding surface as one surface of the holding frame with the opening being covered with the film, a diaphragm that is held on an inner side of the holding frame while being bonded to the film, and a transmission beam that transmits vibration of the vibrating portion to the diaphragm. The film has a first film surface and a second film surface on the opposite side to the first film surface, the film bonding surface and the diaphragm being bonded to the first film surface.

7 Claims, 26 Drawing Sheets

(56) References Cited

FOREIGN PATENT DOCUMENTS

| | | | |
|---|---|---|---|
| JP | 2005-123757 | A | 5/2005 |
| JP | 2012-004851 | A | 1/2012 |

OTHER PUBLICATIONS

Office Action for JP Patent Application No. 2017-562159 dated Jan. 19, 2021, 4 pages of Office Action and 3 pages of English Translation.

* cited by examiner

ACOUSTIC CONVERTER AND SOUND OUTPUT DEVICE

CROSS REFERENCE TO RELATED APPLICATIONS

This application is a U.S. National Phase of International Patent Application No. PCT/JP2016/004965 filed on Nov. 25, 2016, which claims priority benefit of Japanese Patent Application No. JP 2016-007977 filed in the Japan Patent Office on Jan. 19, 2016. Each of the above-referenced applications is hereby incorporated herein by reference in its entirety.

TECHNICAL FIELD

The present technology relates to a technical field of an acoustic converter that transmits vibration of a vibrating portion of an armature to a diaphragm via a transmission beam, and a sound output device including the acoustic converter.

BACKGROUND ART

There is a balanced-armature acoustic converter that is integrated into various sound output devices such as headphones, earphones and hearing aids and serves as a small speaker including an oscillator referred to as an armature.

Such an acoustic converter includes a driver unit including an armature, and a diaphragm unit including a diaphragm. In the diaphragm unit, a holding frame and the diaphragm are connected to each other by a resin film, and the diaphragm is configured to be capable of vibrating with respect to the holding frame. The diaphragm includes a beam portion (transmission beam) extended toward the armature of the driver unit, and the tip of the beam portion is joined to the armature.

When a current is supplied via the armature to a coil opposed thereto, the armature vibrates, that vibration is transmitted to the diaphragm via the beam portion, and the diaphragm vibrates. Controlling the current supplied to the coil enables the diaphragm to be vibrated at a desired number of vibration, thus generating arbitrary sound (for example, Patent Literatures 1 to 4).

CITATION LIST

Patent Literature

Patent Literature 1: Japanese Patent Application Laid-open No. 2012-4850

Patent Literature 2: Japanese Patent Application Laid-open No. 2012-4851

Patent Literature 3: Japanese Patent Application Laid-open No. 2012-4852

Patent Literature 4: Japanese Patent Application Laid-open No. 2012-4853

DISCLOSURE OF INVENTION

Technical Problem

In the balanced-armature acoustic converter as described above, improvement of a sound pressure is expected. In order to improve the sound pressure, it is necessary to enlarge the area of the diaphragm or increase the amplitude of the diaphragm. Meanwhile, the balanced-armature acoustic converter is often mounted to a small device such as earphones, and thus it is not desirable to enlarge the device so as to improve the sound pressure.

In view of the circumstances as described above, it is an object of the present technology to provide a balanced-armature acoustic converter and a sound output device that are capable of improving a sound pressure without increasing the size.

Solution to Problem

In order to achieve the object described above, an acoustic converter according to an embodiment of the present technology includes a driver unit and a diaphragm unit.

The driver unit includes a magnet, a coil to which a driving current is supplied, and an armature including a vibrating portion that vibrates when the driving current is supplied to the coil.

The diaphragm unit includes a holding frame that has an opening, a film that is bonded to a film bonding surface as one surface of the holding frame with the opening being covered with the film, a diaphragm that is held on an inner side of the holding frame while being bonded to the film, and a transmission beam that transmits vibration of the vibrating portion to the diaphragm.

The film bonding surface is located on a first plane.

The film has a first film surface and a second film surface on the opposite side to the first film surface, the film bonding surface and the diaphragm being bonded to the first film surface, the first film surface including an unbonded region that faces the holding frame in a direction perpendicular to the first plane between the film bonding surface and the diaphragm and is not bonded to the holding frame.

The film includes the unbonded region facing the holding frame and being not bonded to the holding frame, and thus a variable area of the film (area of the film between the film bonding surface and the diaphragm) can be enlarged without increasing a clearance between the holding frame and the diaphragm. Compared to a case where the unbonded region is not provided, the area of the diaphragm can be enlarged while the variable area of the film is maintained. Accordingly, a sound pressure of sound generated by the acoustic converter can be improved.

The holding frame may include a first chamfered portion, the first chamfered portion being recessed relative to the first plane in a circumference of the opening located in the first plane, separating the first film surface from the holding frame, and forming the unbonded region.

The chamfered portion is formed in the circumference of the opening of the holding frame, and thus the unbonded region can be formed, and the film that vibrates together with the diaphragm can also be prevented from coming into contact with the holding frame.

The film may be curved between the film bonding surface and the diaphragm such that a cross-section of the film has an S-shape.

According to this configuration, a variable range of the film can be increased compared to a case where the film is flat between the film bonding surface and the diaphragm. Accordingly, the amplitude of the diaphragm can be increased, and the sound pressure of the sound generated by the acoustic converter can be improved.

The acoustic converter may further include a cover body that is joined to the holding frame via the film and surrounds the diaphragm, and includes a film abutting surface that abuts on the second film surface, in which the film abutting surface is located on a second plane parallel to the first plane, and the cover body includes a second chamfered portion, the second chamfered portion being recessed relative to the second plane in a circumference of the cover body and separating a back side region of the unbonded region in the second film surface from the cover body.

According to this configuration, the second chamfered portion can prevent the film that vibrates together with the diaphragm from coming into contact with the cover body.

A part of a circumference of the diaphragm may be joined to the holding frame, and the first chamfered portion may be provided to a portion of the circumference of the opening, the portion being separated from the diaphragm.

The entire circumference of the diaphragm may be separated from the holding frame, and the first chamfered portion may be provided to the entire circumference of the opening.

In order to achieve the object described above, a sound output device according to an embodiment of the present technology includes an acoustic converter including a driver unit and a diaphragm unit.

The driver unit includes a magnet, a coil to which a driving current is supplied, and an armature including a vibrating portion that vibrates when the driving current is supplied to the coil.

The diaphragm unit includes a holding frame that has an opening, a film that is bonded to a film bonding surface as one surface of the holding frame with the opening being covered with the film, a diaphragm that is held on an inner side of the holding frame while being bonded to the film, and a transmission beam that transmits vibration of the vibrating portion to the diaphragm.

The film bonding surface is located on a first plane.

The film has a first film surface and a second film surface on the opposite side to the first film surface, the film bonding surface and the diaphragm being bonded to the first film surface, the first film surface including an unbonded region that faces the holding frame in a direction perpendicular to the first plane between the film bonding surface and the diaphragm and is not bonded to the holding frame.

Advantageous Effects of Invention

As described above, according to the present technology, it is possible to provide a balanced-armature acoustic converter and a sound output device that are capable of improving a sound pressure without increasing the size.

MODE(S) FOR CARRYING OUT THE INVENTION

Hereinafter, an embodiment of an acoustic converter and a sound output device of the present technology will be described in accordance with the appended drawings.

In the following description, forward, backward, upper, lower, right, and left directions will be used in relation to a direction in which sound is output, which is forward. Note that the forward, backward, upper, lower, right, and left directions shown below are for convenience of description, and implementation of the present technology is not restricted to those directions.

<Overall Configuration>

Figure 1:
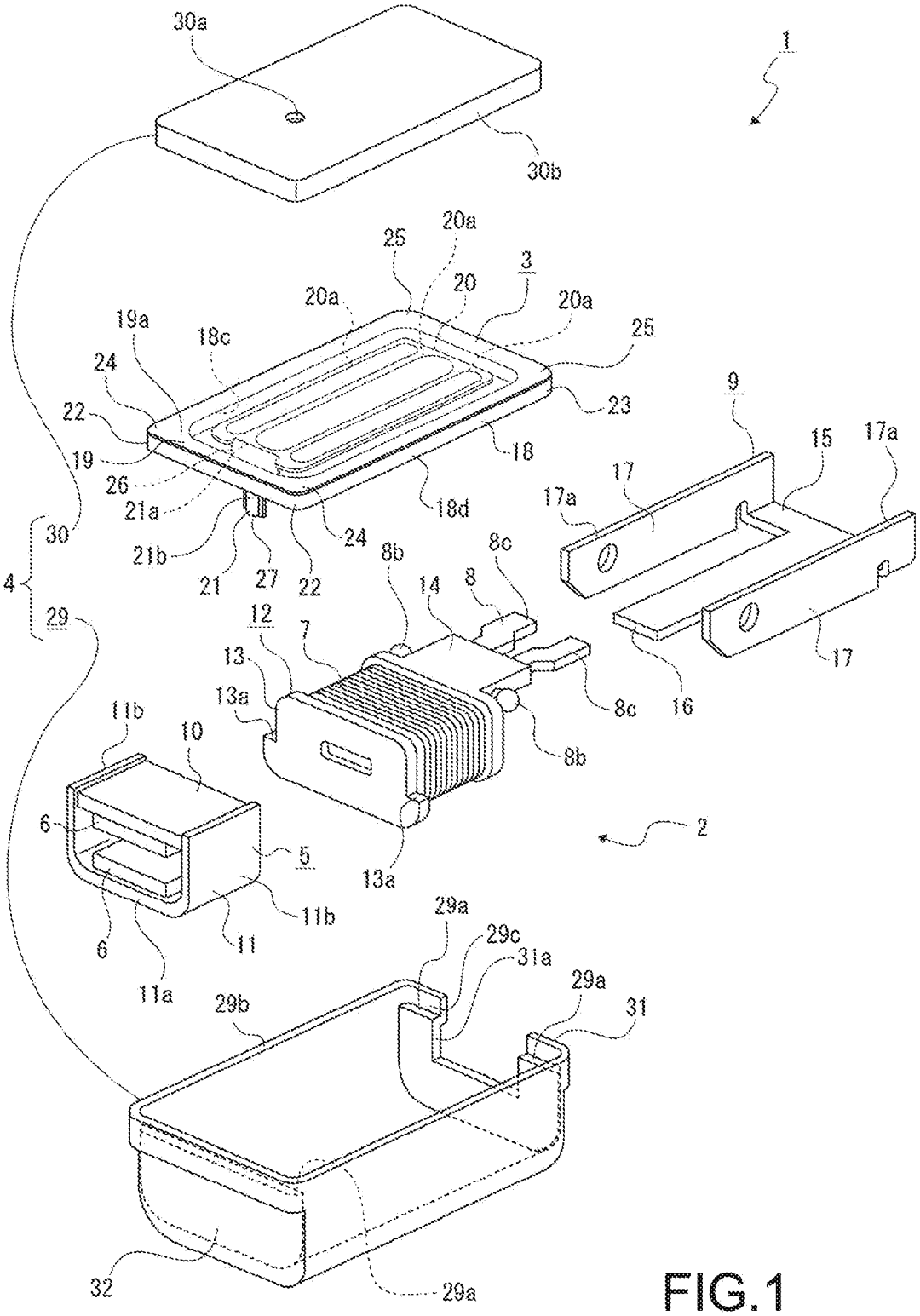
FIG. 1 is an exploded perspective view of an acoustic converter according to an embodiment of the present technology.
Figure 2:
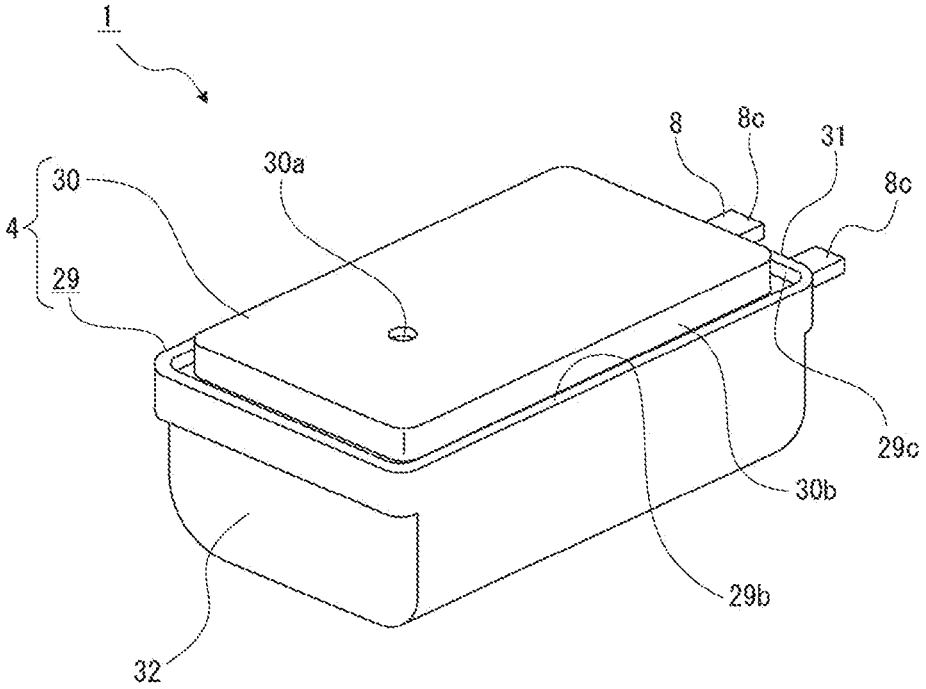
FIG. 2 is a perspective view of a storage unit of the acoustic converter.
Figure 3:
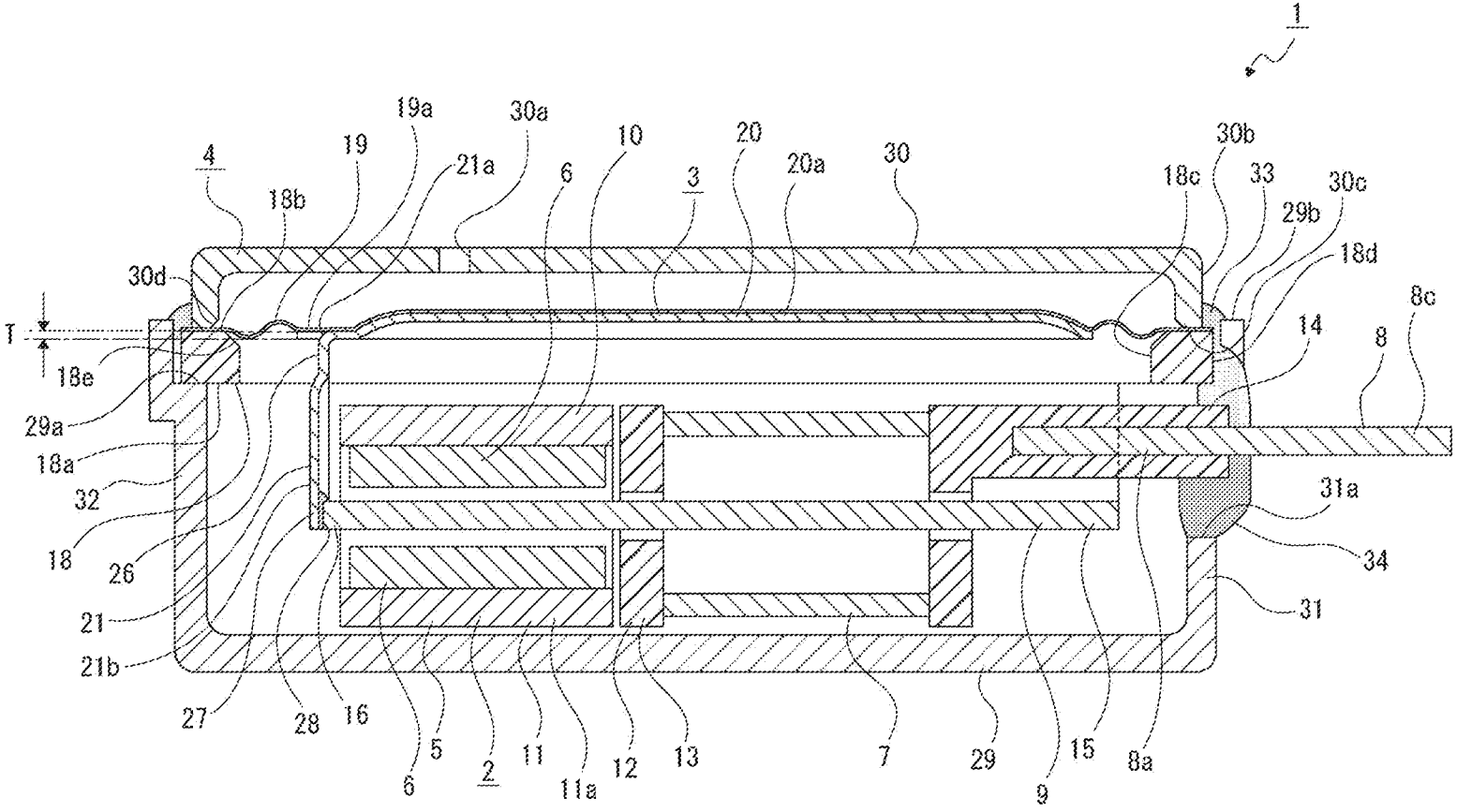
FIG. 3 is a cross-sectional view of the acoustic converter.

An acoustic converter 1 includes a driver unit 2, a diaphragm unit 3, and a storage unit 4 (see FIGS. 1 through 3). The acoustic converter 1 is integrated into various sound output devices such as headphones, earphones, and hearing aids and then used.

The driver unit 2 includes a yoke 5, a pair of magnets 6, 6, a coil 7, connection terminals 8, 8, and an armature 9 (see FIGS. 1 and 3).

The yoke 5 is formed of a magnetic material and includes a plate-shaped first member 10 directed in the vertical direction, and a U-shaped second member 11 opened upward, which are combined with each other. The second member 11 includes a bottom surface portion 11*a* directed in the vertical direction, and side surface portions 11*b*, 11*b* protruding upward from both of the right and left end portions of the bottom surface portion 11*a*.

Both of the right and left side surfaces of the first member 10 are attached to the inner surfaces of the side surface portions 11*b*, 11*b* of the second member 11 by, for example, adhesion or bonding. The yoke 5 is formed into a square tubular shape where the first member 10 and the second member 11 are combined with each other and pierced backward and forward.

The magnets 6, 6 are disposed in a state isolated in the vertical direction and facing each other, and the poles on the facing sides are different poles. The magnet 6 located upward is attached to the lower surface of the first member 10, and the magnet 6 located downward is attached to the upper surface of the bottom surface portion 11*a* of the second member (see FIG. 4).

The coil 7 is wound around a coil bobbin 12 (see FIG. 1 and FIG. 3). The coil bobbin 12 includes a coil winding portion 13 vertically opened and pierced backward and forward, and a terminal holding portion 14 protruding rearward from the upper end portion of the rear surface of the coil winding portion 13. The coil winding portion 13 includes, at the front end portion thereof, receiving protruding portions 13*a*, 13*a* protruding horizontally.

The coil 7 is wound around the coil winding portion 13 with the axial direction being set as the front-back direction.

The connection terminals 8, 8 are held in a state horizontally arranged on the terminal holding portion 14 of the coil bobbin 12. The connection terminal 8 includes a buried portion 8*a* buried and held in the terminal holding portion 14, a coil connection portion 8*b* protruding laterally from the buried portion 8*a*, and a terminal portion 8*c* protruding rearward from the buried portion 8*a*. The coil connection portion 8*b* laterally protrudes from the side surface of the terminal holding portion 14, and the terminal portion 8*c* protrudes rearward from the rear surface of the terminal holding portion 14.

Both of the end portions of the coil 7 are connected to the respective coil connection portions 8*b*, 8*b* of the connection terminals 8, 8. The terminal portions 8*c*, 8*c* are connected to an input signal source that is not shown in the figures. Therefore, an input signal is supplied from the input signal source to the coil 7 via the connection terminals 8, 8.

The armature 9 is integrally formed of portions made of a magnetic metal material. The armature 9 is integrally formed of a base portion 15 formed into a horizontally long shape directed in the vertical direction, a vibrating portion 16 protruding forward from the center portion in the horizontal direction of the base portion 15, and fixed portions 17, 17 protruding forward from both of the right and left end portions of the base portion 15. The vibrating portion 16 is formed into a plate shape directed in the vertical direction, and the fixed portions 17, 17 are each formed into a plate shape directed in the horizontal direction. The upper surfaces of the fixed portions 17, 17 are formed as fixing surfaces 17*a*, 17*a*.

Figure 5:
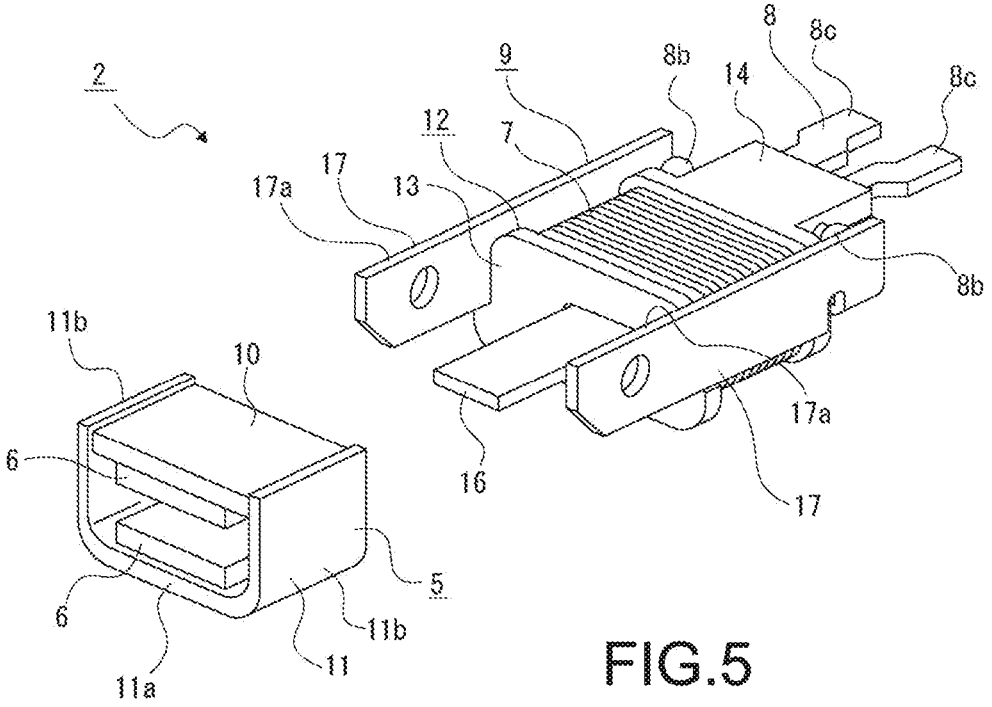
FIG. 5 is an exploded perspective view of a driver unit of the acoustic converter.

The coil bobbin 12 is attached to the armature 9 by bonding the coil 7 to the inner surfaces of the fixed portions 17, 17 (see FIG. 3 and FIG. 5).

In the state where the coil bobbin 12 is attached to the armature 9, the vibrating portion 16 penetrates the coil winding portion 13 of the coil bobbin 12 and a part thereof protrudes forward from the coil 7 (see FIG. 3). At that time, the middle portions of the fixed portions 17, 17 are respectively placed on the receiving protruding portions 13*a*, 13*a* of the coil bobbin 12, so that the positioning of the armature 9 with respect to the coil bobbin 12 is performed (see FIG. 5).

In the acoustic converter 1, both of the fixed portions 17, 17 to which the coil 7 is attached, and the vibrating portion 16 penetrating the coil bobbin 12 are provided to the armature 9. Therefore, the position of the vibrating portion 16 with respect to the coil bobbin 12 and the coil 7 can be secured with high precision, and improvement in positional precision of the vibrating portion 16 with respect to the coil bobbin 12 and the coil 7 can be achieved.

Figure 4:
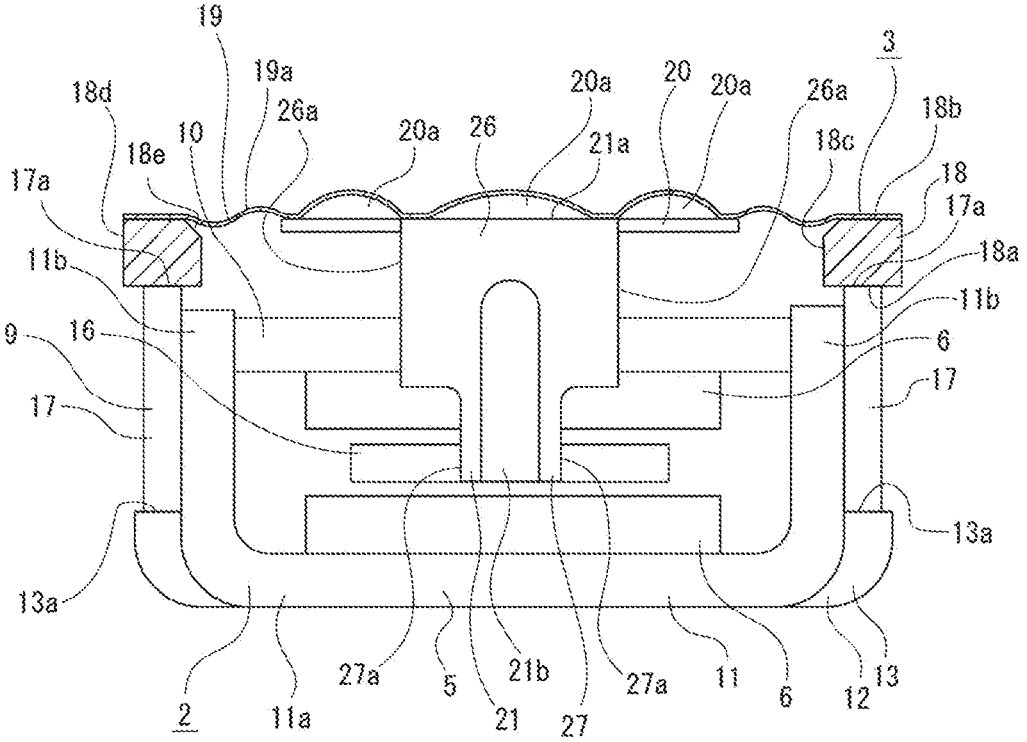
FIG. 4 is a plan view of the acoustic converter.
Figure 6:
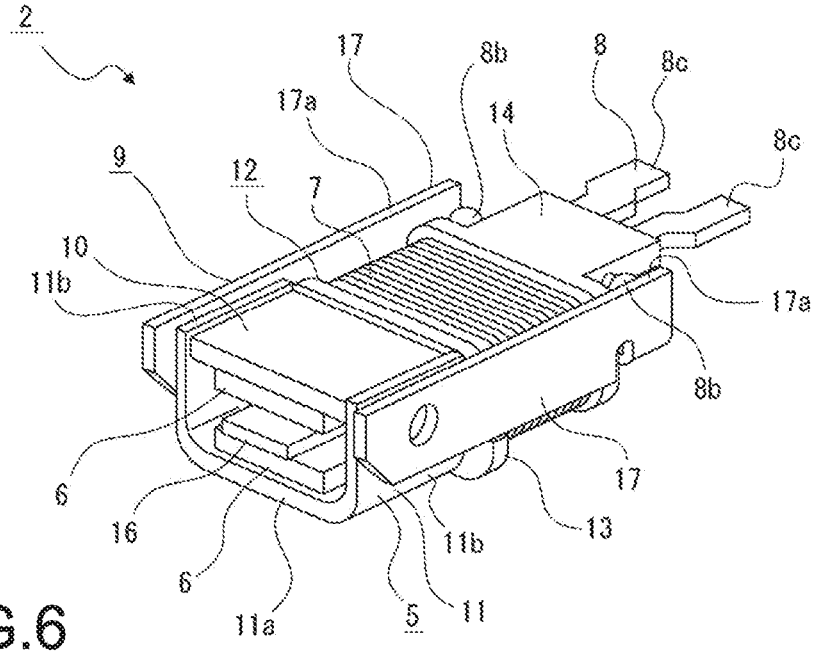
FIG. 6 is a perspective view of the driver unit of the acoustic converter.

In the armature 9, in the state where the coil bobbin 12 is attached to the armature 9, the fixed portions 17, 17 are fixed to the outer surfaces of the side surface portions 11*b*, 11*b* of the yoke 5 by bonding, adhesion, or the like (FIG. 4 and FIG. 6).

In the state where the armature 9 is fixed to the yoke 5, the fixing surfaces 17*a*, 17*a* of the armature 9 are located slightly upward relative to the upper surfaces of the side surface portions 11*b*, 11*b* of the yoke 5 (see FIG. 4).

Figure 7:
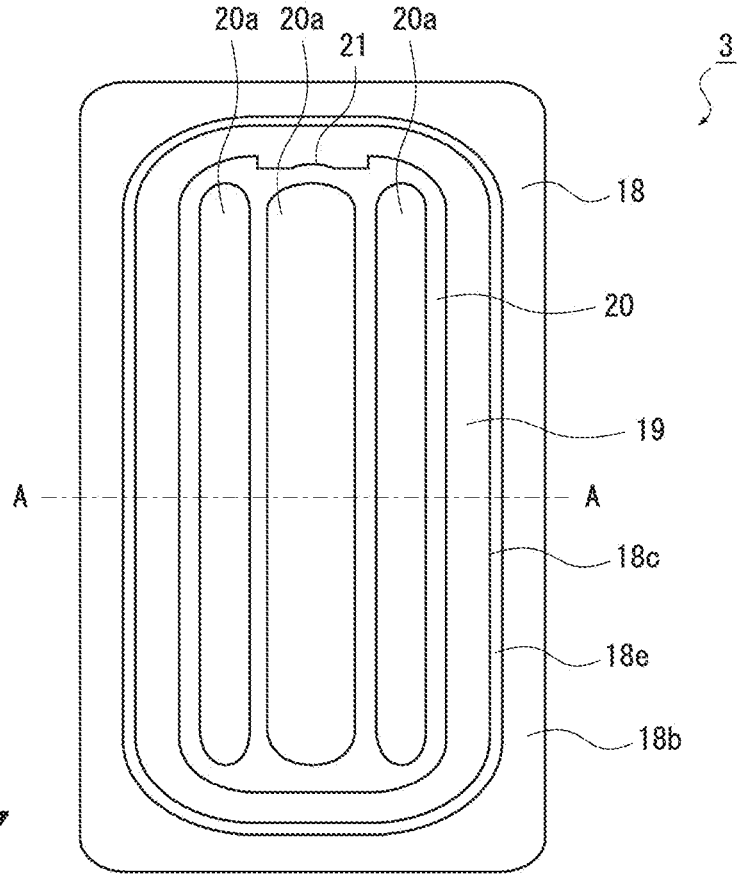
FIG. 7 is a plan view of a diaphragm unit of the acoustic converter.
Figure 8:
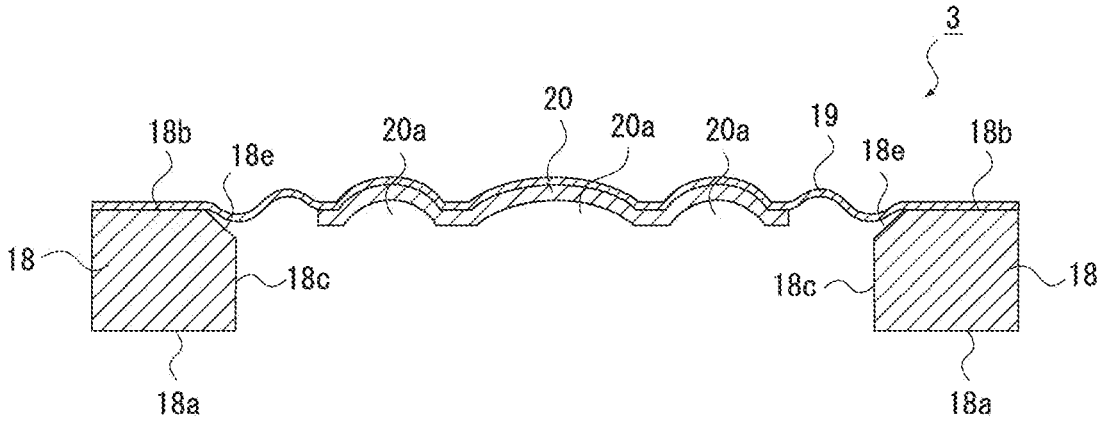
FIG. 8 is a cross-sectional view of the diaphragm unit of the acoustic converter.

The diaphragm unit 3 includes a holding frame 18, a film 19, a diaphragm 20, and a transmission beam 21 (see FIG. 1 and FIG. 3). Examples of the film 19 include a resin film or a paper film. FIG. 7 is a plan view of the diaphragm unit 3. Note that FIG. 7 shows the film 19 in a transparent manner. FIG. 8 is a cross-sectional view of the diaphragm unit 3 taken along the line A-A of FIG. 7.

The holding frame 18 is formed, for example, of a metal material and into a substantially rectangular frame shape, in which the length in the front-back direction is set to be longer than the length in the horizontal direction, and the width in the horizontal direction is set to be substantially the same as the width of the armature 9 in the horizontal direction. The lower surface of the holding frame 18 is a surface to be joined to the armature 9 and is hereinafter referred to as a joint surface 18*a*. Further, the upper surface of the holding frame 18 is a surface on which the film 19 is to be bonded, and is hereinafter referred to as a film bonding surface 18*b*.

Figure 9:
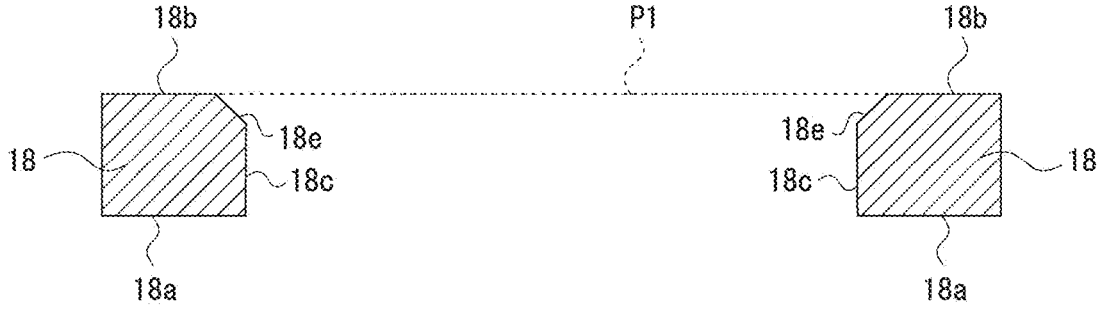
FIG. 9 is a cross-sectional view of a holding frame of the diaphragm unit of the acoustic converter.
Figure 10:
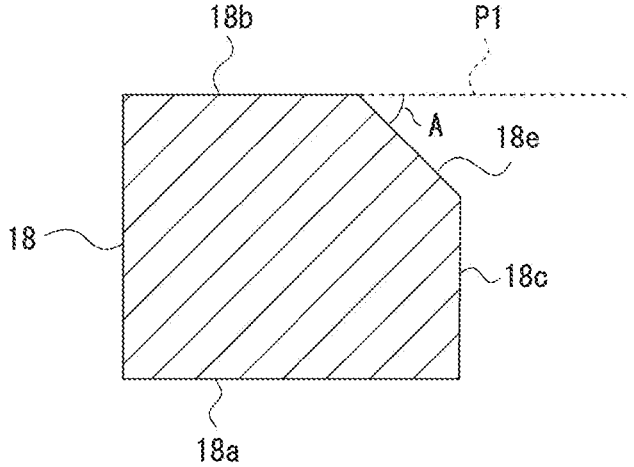
FIG. 10 is an enlarged cross-sectional view of the holding frame of the diaphragm unit of the acoustic converter.

FIG. 9 is a cross-sectional view of the holding frame 18 taken along the line A-A (FIG. 7), and FIG. 10 is an enlarged view of FIG. 9. As shown in those figures, the holding frame 18 includes a chamfered portion 18*e*. As shown in FIG. 9, the chamfered portion 18*e* is a portion where the corner between the inner circumferential surface of an opening 18*c* and the film bonding surface 18*b* is chamfered.

Assuming that a virtual plane where the film bonding surface 18*b* is located is a first plane P1, the chamfered portion 18*e* is recessed relative to the first plane P1 in the circumference of the opening 18*c* located on the first plane P1 and separates the holding frame 18 from the first plane P1.

As shown in FIG. 7, the chamfered portion 18*e* can be formed over the entire circumference of the opening 18*c*. Note that, as will be described later, the chamfered portion 18*e* does not need to be formed over the entire circumference depending on the joint state of the diaphragm 20 and the holding frame 18.

A specific shape of the chamfered portion 18*e* can be, as shown in FIG. 10, an inclined surface that is inclined with respect to the first plane P1 from the film bonding surface 18*b* toward the inner circumferential surface of the opening 18*c* so as to be gradually separated from the first plane P1. The inclination angle with respect to the first plane P1 (in the figure, A) is suitably set to be approximately 45°.

The holding frame 18 can be formed by press working.

Figure 11:
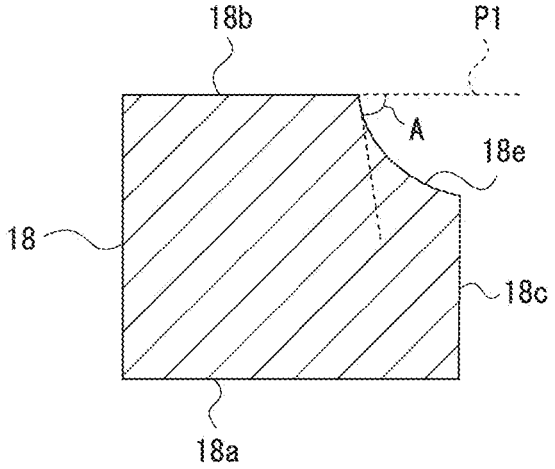
FIG. 11 is an enlarged cross-sectional view of a holding frame having another shape of the diaphragm unit of the acoustic converter.
Figure 12:
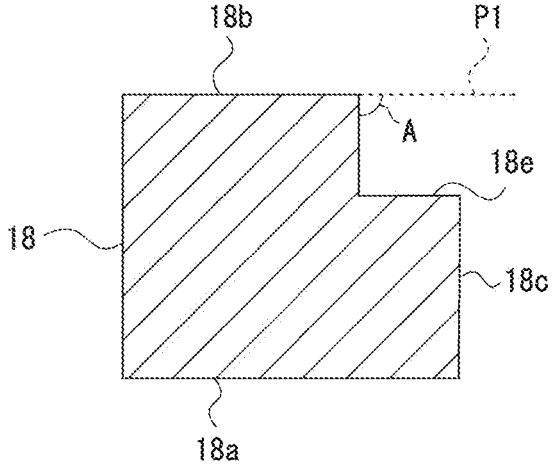
FIG. 12 is an enlarged cross-sectional view of a holding frame having another shape of the diaphragm unit of the acoustic converter.

Further, the chamfered portion 18*e* is not limited to the shape as described above and only needs to be formed in the circumference of the opening 18*c* located on the first plane P1 and has a structure recessed relative to the first plane P1. FIG. 11 and FIG. 12 are other configuration examples of the chamfered portion 18*e*. The chamfered portion 18*e* may be a concave curved surface as shown in FIG. 11 or step-like as shown in FIG. 12.

For the angle (in the figures, A) of the chamfered portion 18*e* in the vicinity of the film bonding surface 18*b* with respect to the first plane P1, an angle larger than approximately 45° is suitable. If this angle is small, the effect of the chamfered portion 18*e* that will be described later is reduced.

The size of the film 19 is set to be the same as that of the outer shape of the holding frame 18, and the film 19 is attached onto the film bonding surface 18*b* of the holding frame 18 by bonding so as to occlude the opening 18*c* of the holding frame 18 (see FIG. 3).

Figure 13:
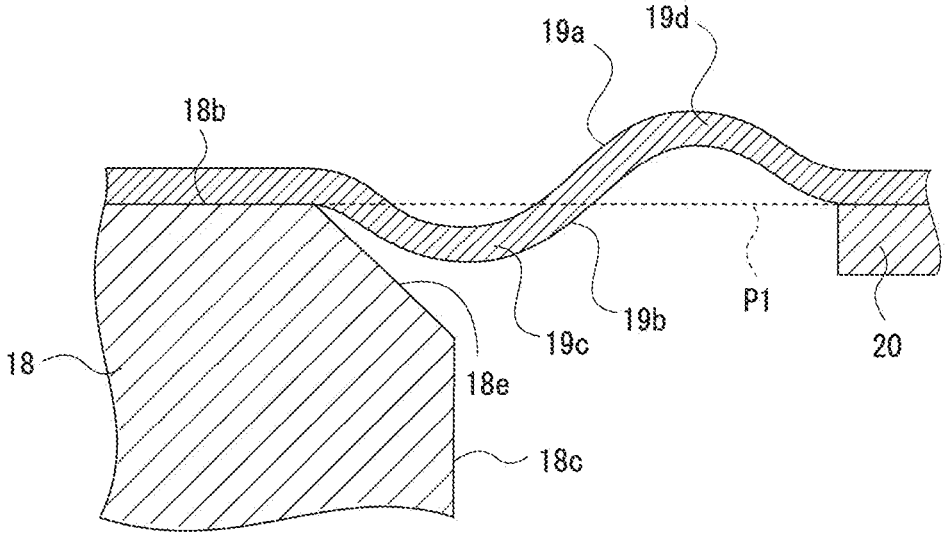
FIG. 13 is an enlarged cross-sectional view of a film of the diaphragm unit of the acoustic converter.

FIG. 13 is a cross-sectional view of the film 19 and an enlarged view of FIG. 8. As shown in the figure, out of the surfaces of the film 19, the surface on the side to be bonded to the film bonding surface 18*b* is assumed as a first film surface 19*b*, and the surface on the side opposite to the first film surface 19*b* is assumed as a second film surface 19*a*. As shown in FIG. 13, the film 19 is curved between the film bonding surface 18*b* and the diaphragm 20 such that the cross-section of the film 19 has an S-shape, and includes a first curved portion 19*c* and a second curved portion 19*d*.

The first curved portion 19*c* protrudes to the first film surface 19*b* side relative to the first plane P1 and is adjacent to the holding frame 18 and the second curved portion 19*d*. The second curved portion 19*d* protrudes to the second film surface 19*a* side relative to the first plane P1 and is adjacent to the first curved portion 19*c* and the diaphragm 20.

Figure 14:
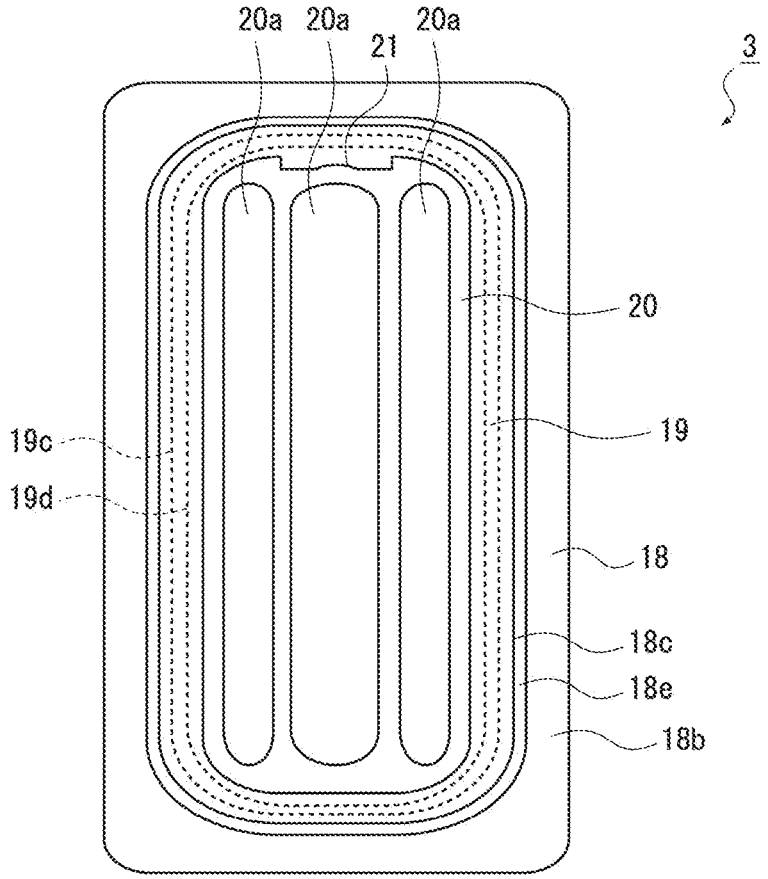
FIG. 14 is a plan view of the diaphragm unit of the acoustic converter.

FIG. 14 is a plan view of the diaphragm unit 3, showing the positions of the first curved portion 19*c* and the second curved portion 19*d*. As shown in the figure, the second curved portion 19*d* is provided around the diaphragm 20, and the first curved portion 19*c* is provided around the second curved portion 19*d*.

Figure 15:
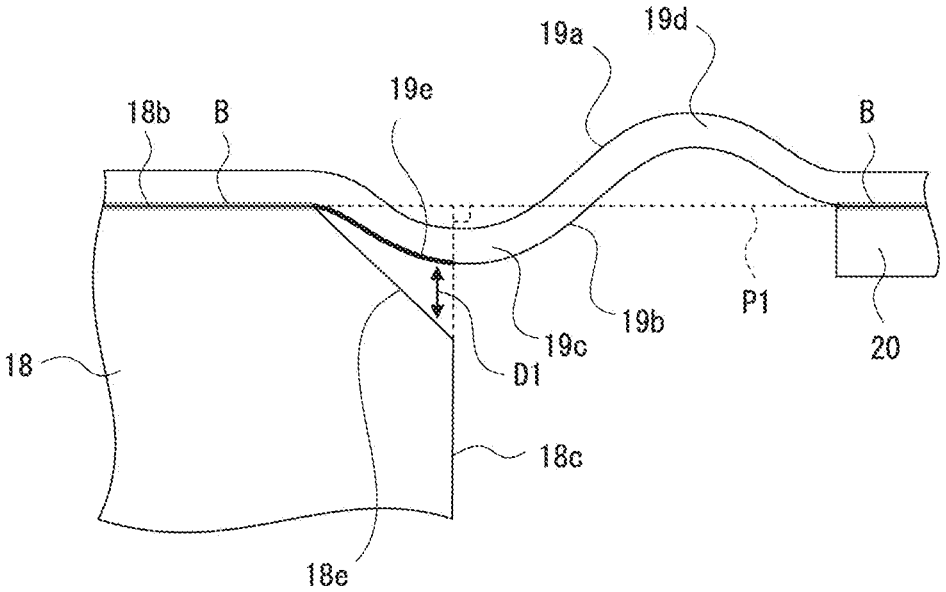
FIG. 15 is a schematic view of the diaphragm unit of the acoustic converter.

Here, the first curved portion 19*c* is prevented from coming into contact with the holding frame 18 by the chamfered portion 18*e* provided to the holding frame 18. FIG. 15 is a schematic view of the first curved portion 19*c* and the chamfered portion 18*e*. As shown in the figure, the first film surface 19*b* includes an unbonded region 19*e*.

The unbonded region 19*e* is a region in the first film surface 19*b*, the region facing the holding frame 18 in a direction perpendicular to the first plane P1 (in the figure, the arrow D1) between the film bonding surface 18*b* and the diaphragm 20. Although an adhesive agent B is disposed on the film bonding surface 18*b*, the film 19 is separated from the holding frame 18 by the chamfered portion 18*e*, and thus the unbonded region 19*e* is formed.

Note that the film 19 does not necessarily have an S-shaped cross-section and only needs to have the unbonded region 19*e*. For example, the film 19 may be flat between the film bonding surface 18*b* and the diaphragm 20. Also in this case, the unbonded region 19*e* is formed by the chamfered portion 18*e*.

Figure 16:
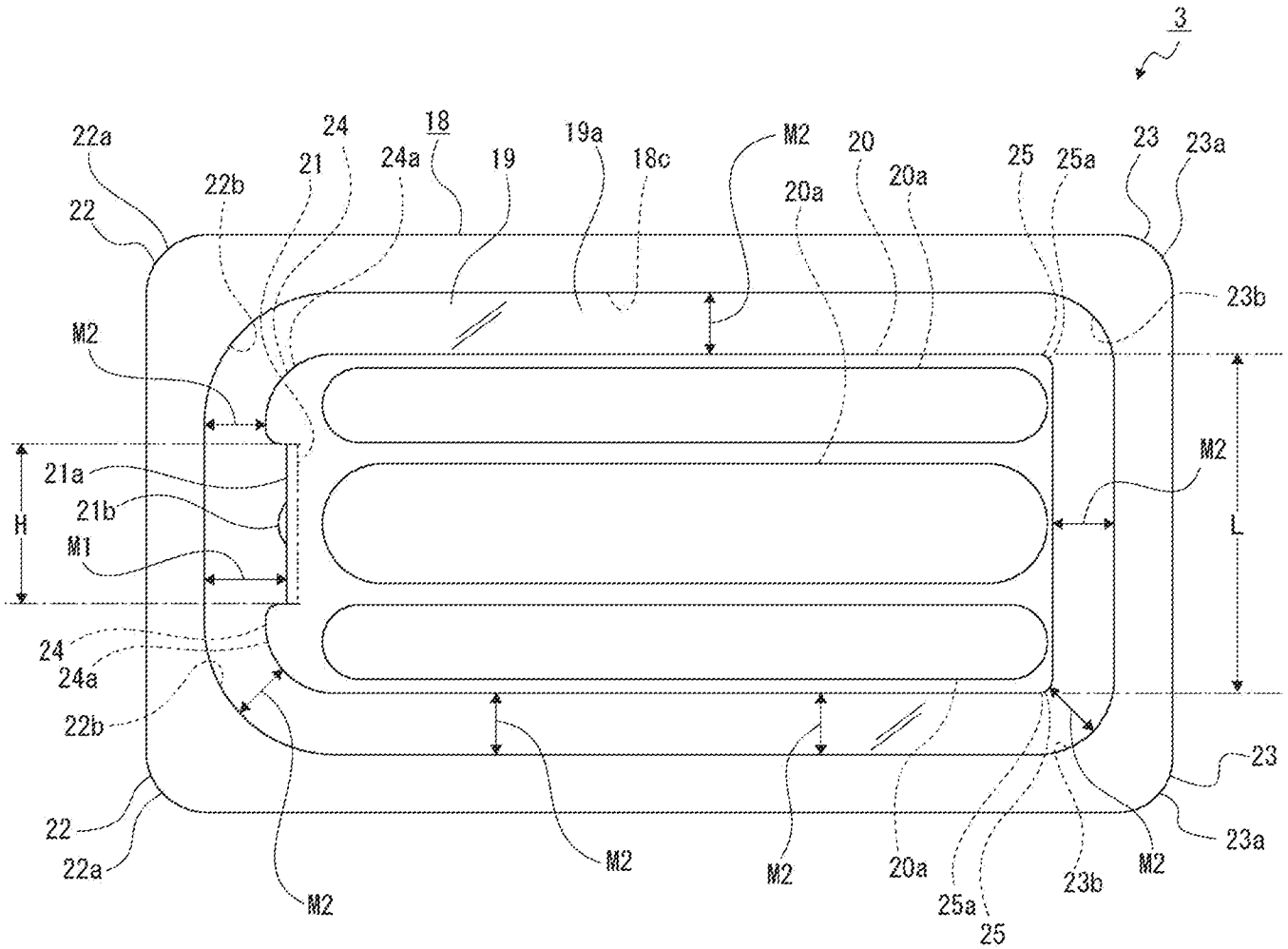
FIG. 16 is a plan view of the diaphragm unit of the acoustic converter.

The holding frame 18 is formed into a shape where four corner portions 22, 22, 23, 23 are not angular but rounded (see FIG. 16). Outer circumferences 22*a*, 22*a* of the forward corner portions 22, 22 and outer circumferences 23*a*, 23*a* of the rearward corner portions 23, 23 are each formed into an arc-like shape having the same curvature. Further, inner circumferences 22*b*, 22*b* of the forward corner portions 22, 22 are each formed into an arc-like shape having a larger curvature than that of the outer circumferences 22*a*, 22*a*, and inner circumferences 23*b*, 23*b* of the rearward corner portions 23, 23 are each formed into an arc-like shape having a larger curvature than that of the outer circumferences 23*a*, 23*a*.

The diaphragm 20 is formed into a substantially rectangular shape whose outer shape is slightly smaller than the inner shape of the holding frame 18. Vibration generated in the vibrating portion 16 of the armature 9 is transmitted to the diaphragm 20 via the transmission beam 21.

The diaphragm 20 is formed of a thin metal material, for example, aluminum or stainless steel. In the diaphragm 20, a thickness T thereof (see FIG. 3) is set to, for example, approximately 50 μm, and a width L in the horizontal direction (see FIG. 16) is set to, for example, approximately 2.3 mm.

With the diaphragm 20 formed of aluminum, reduction in weight can be achieved. Meanwhile, with the diaphragm 20 formed of stainless steel, increase in strength and improvement in transmission efficiency of the vibration from the vibrating portion 16 to the diaphragm 20 can be achieved.

The diaphragm 20 includes reinforcing ribs 20*a*, 20*a*, 20*a* extending backward and forward and being horizontally isolated from each other. The reinforcing ribs 20*a*, 20*a*, 20*a* are each formed into a shape embossed upward or downward (see FIG. 17).

The diaphragm 20 is in an attached state to the film 19 from below, for example (see FIG. 3).

The diaphragm 20 is formed into a shape where four corner portions 24, 24, 25, 25 are not angular but rounded (see FIG. 16). Outer circumferences 24*a*, 24*a* of the forward corner portions 24, 24 are each formed into an arc-like shape having a larger curvature than that of the inner circumferences 22*b*, 22*b* of the forward corner portions 22, 22 of the holding frame 18, and the center of the arc of each of the outer circumferences 24*a*, 24*a* and the center of the arc of each of the inner circumferences 22*b*, 22*b* coincides with each other. Further, outer circumferences 25*a*, 25*a* of the rearward corner portions 25, 25 are each formed into an arc-like shape having a larger curvature than that of the inner circumferences 23*b*, 23*b* of the rearward corner portions 23, 23 of the holding frame 18, and the center of the arc of each of the outer circumferences 25*a*, 25*a* and the center of the arc of each of the inner circumferences 23*b*, 23*b* coincides with each other.

In such a manner, in the diaphragm unit 3, the outer shape of the diaphragm 20 is slightly smaller than the inner shape of the holding frame 18, the center of the arc of each of the outer circumferences 24*a*, 24*a* and the center of the arc of each of the inner circumferences 22*b*, 22*b* coincides with each other, and the center of the arc of each of the outer circumferences 25*a*, 25*a* and the center of the arc of each of the inner circumferences 23*b*, 23*b* coincides with each other.

Therefore, a distance M between the inner shape of the holding frame 18 and the outer shape of the diaphragm 20 is set to have a constant size, except for part of the entire circumference. Note that, as will be described later, since the transmission beam 21 is formed by being bent from the diaphragm 20, and the bent portion is located inward relative to the other portions of the outer circumference of the diaphragm 20, a distance M1 between the bent portion and the inner circumference of the diaphragm 20 is larger than a distance M2 between the non-bent portion and the inner circumference of the diaphragm 20. It should be noted that the distance M1 may be set to be the same as the distance M2 so as to make the distance M equal in the entire circumference by changing the position of the transmission beam 21 that is bent from the diaphragm 20.

Figure 17:
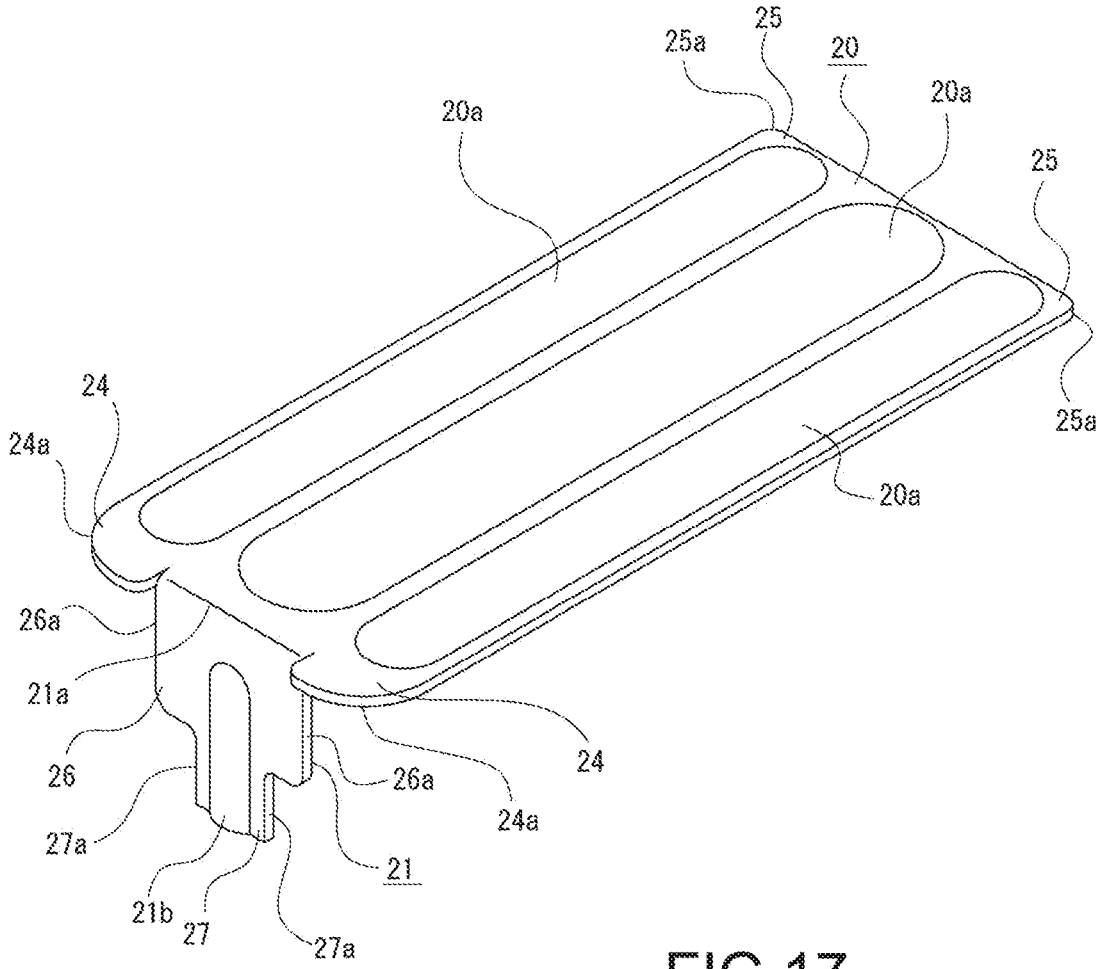
FIG. 17 is a plan view of the diaphragm unit of the acoustic converter.

The transmission beam 21 is formed integrally with the diaphragm 20 and, for example, formed by being bent downward from the diaphragm 20 (see FIG. 17). The transmission beam 21 is formed by being bent downward from the center portion in the horizontal direction of the front edge of the diaphragm 20. A bent portion 21*a* obtained by bending the transmission beam 21 from the diaphragm 20 is located inward relative to the other portions of the outer circumference of the diaphragm 20. A width H of the bent portion 21*a* in the horizontal direction is set to, for example, approximately 1.1 mm.

Note that the transmission beam 21 may be formed separately from the diaphragm 20 and attached to the diaphragm 20 by bonding or adhesion. It should be noted that when the transmission beam 21 is formed separately from the diaphragm 20, the transmission beam 21 is desirably attached to the diaphragm 20 by adhesion in order to improvement the strength.

Further, the transmission beam 21 may be formed of, for example, a round-shaft-shaped metal column having the diameter of approximately 1 mm.

The transmission beam 21 is formed into a plate directed in the front-back direction and includes a base portion 26 continuous to the diaphragm 20 and a coupling portion 27 continuous to the lower end of the base portion 26. The base portion 26 has a constant width in the horizontal direction and is linearly formed such that side edges 26*a*, 26*a* extend vertically. The coupling portion 27 has a constant width in the horizontal direction, and the width in the horizontal direction is smaller than the width of the base portion 26 in the horizontal direction. The coupling portion 27 is linearly formed such that side edges 27*a*, 27*a* extend vertically. The side edges 27*a*, 27*a* are located inward relative to the side edges 26*a*, 26*a* of the base portion 26.

The transmission beam 21 includes a rib 21*b* that is formed from the lower end thereof to substantially the center portion of the base portion 26 in the vertical direction. The rib 21*b* is formed into a shape embossed forward or rearward.

As described above, in the acoustic converter 1, the transmission beam 21 includes the base portion 26 continuous to the diaphragm 20, and the coupling portion 27 that is continuous to the base portion 26 and coupled to the vibrating portion 16, in which the width of the base portion 26 is larger than that of the coupling portion 27.

Therefore, the width of the portion (bent portion 21*a*) continuous to the diaphragm 20 in the transmission beam 21 becomes larger, and thus the strength of the transmission beam 21 becomes higher, so that improvement in transmission efficiency of the vibration from the vibrating portion 16 to the diaphragm 20 can be achieved.

Further, since the width of the base portion 26 and the width of the coupling portion 27 are each set to be constant, the base portion 26 and the coupling portion 27 have the same strength irrespective of the respective positions in the continuous direction (vertical direction) thereof, so that further improvement in transmission efficiency of the vibration from the vibrating portion 16 to the diaphragm 20 can be achieved.

Furthermore, one or more reinforcing ribs, for example, 20*a*, 20*a*, 20*a* are formed in the diaphragm 20, and thus the strength of the diaphragm 20 is increased, and deflection of the diaphragm 20 is suppressed when vibration occurs. This enables the diaphragm 20 to easily translate so as to be displaced in the thickness direction, and also makes it possible to secure an optimal vibration state of the diaphragm 20.

Besides, since the transmission beam 21 includes the rib 21*b*, the strength of the transmission beam 21 is increased, deflection of the transmission beam 21 is suppressed when vibration occurs, and thus further improvement in transmission efficiency of the vibration from the vibrating portion 16 to the diaphragm 20 can be achieved.

Figure 18:
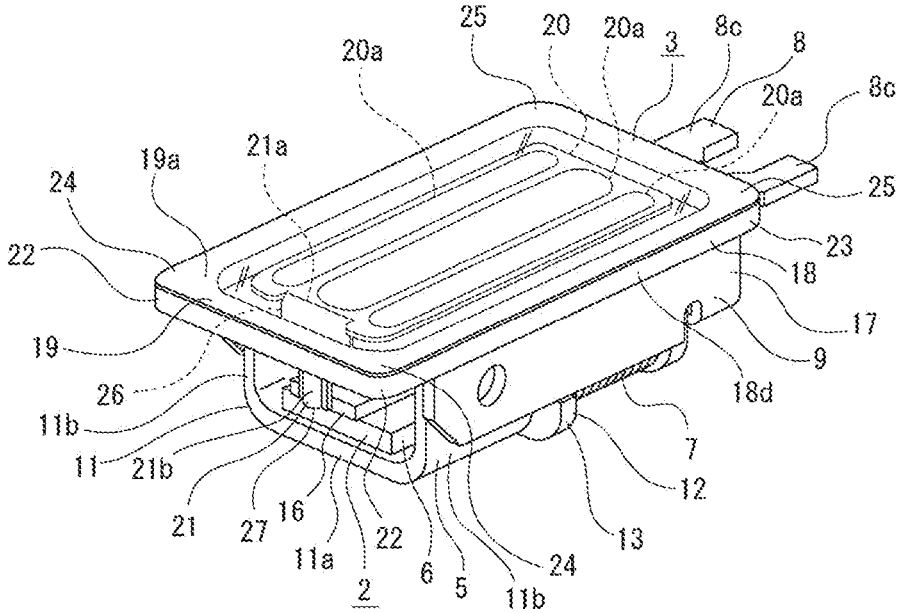
FIG. 18 is a perspective view of the diaphragm unit and the driver unit of the acoustic converter.

The diaphragm unit 3 is fixed to the driver unit 2 from above by, for example, bonding or laser welding (see FIG. 3 and FIG. 18). The diaphragm unit 3 is fixed by joining the joint surface 18*a* of the holding frame 18 to the fixing surfaces 17*a*, 17*a* formed in the fixed portions 17, 17 of the armature 9.

At the time of fixing the driver unit 2 to the diaphragm unit 3, the lower end portion of the transmission beam 21 is fixed to the front end portion of the vibrating portion 16 of the armature 9 by an adhesive agent 28 (see FIG. 3 and FIG. 4).

As described above, since the transmission beam 21 is formed by being bent from the diaphragm 20, the transmission beam 21 and the diaphragm 20 are integrally formed. The diaphragm 20 and the armature 9 are coupled to each other via the transmission beam 21 only by fixing the lower end portion of the transmission beam 21 to the vibrating portion 16, so that improvement in working efficiency in coupling between the diaphragm 20, the transmission beam 21, and the armature 9 can be achieved.

Further, since the transmission beam 21 is formed by being bent from the diaphragm 20, the transmission beam 21 and the diaphragm 20 are integrally formed, and thus it is unnecessary to attach the upper end portion of the transmission beam 21 to the diaphragm 20 in the state where the lower end of the transmission beam 21 is fixed to the vibrating portion 16 of the armature 9. Therefore, it is unnecessary to attach the upper end portion of the transmission beam 21 to the diaphragm 20 by feel, and improvement in yield can be achieved without causing shifting of the coupled position of the transmission beam 21 to the diaphragm 20, deformation of the transmission beam 21, bending of the transmission beam 21 to the diaphragm 20, and so forth.

Furthermore, since the transmission beam 21 and the diaphragm 20 are integrally formed, the number of components in the acoustic converter 1 can be reduced, and improvement in transmission efficiency of vibration from the vibrating portion 16 to the diaphragm 20 can also be achieved.

The storage unit 4 includes a box-shaped case body 29 opened upward, and a shallow box-shaped cover body 30 opened downward (see FIGS. 1 through 3).

The case body 29 includes an insertion notch 31*a* opened upward in the upper end portion of a rear surface portion 31. Installation stepped surfaces 29*a*, 29*a*, 29*a* each directed upward are formed on the inner surface side of the upper end portions of a front surface portion 32 and the rear surface portion 31 of the case body 29.

The cover body 30 includes a sound output hole 30*a*. Note that the sound output hole may be formed in the case body 29.

As described above, the joint surface 18*a* of the holding frame 18 is joined to the fixing surfaces 17*a*, 17*a* of the armature 9, and the lower end portion of the transmission beam 21 is attached to the front end portion of the vibrating portion 16 of the armature 9 by the adhesive agent 28, so that the driver unit 2 and the diaphragm unit 3 are combined with each other.

Figure 19:
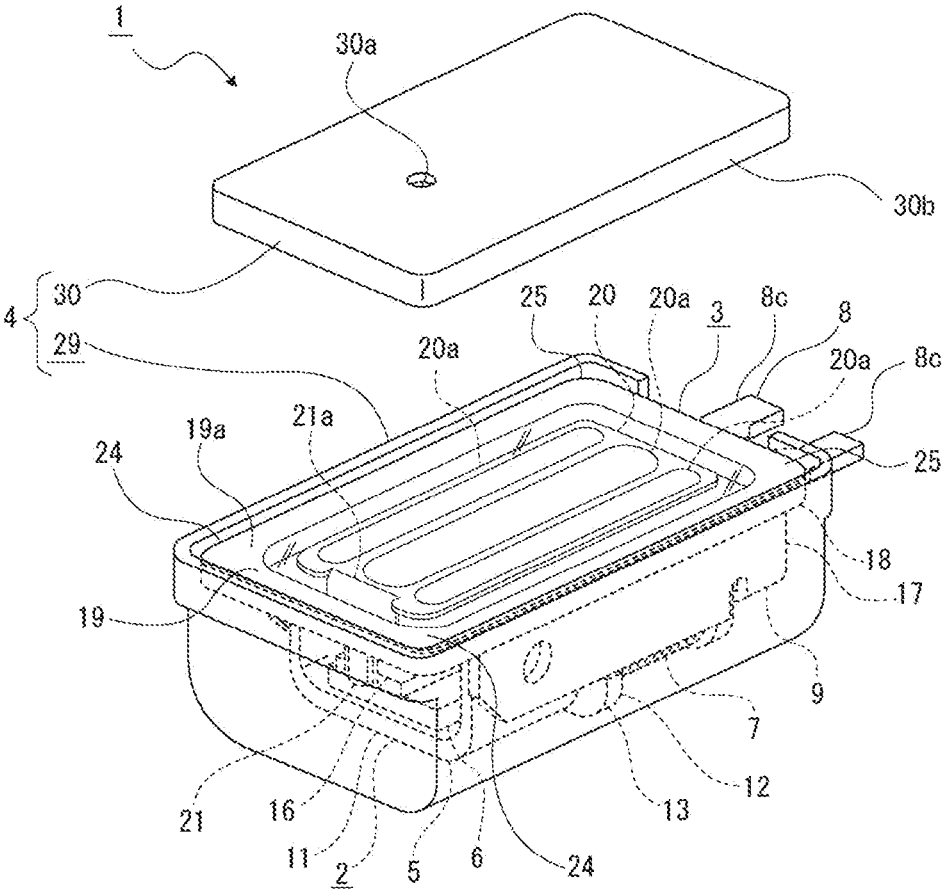
FIG. 19 is an exploded perspective view of the acoustic converter.

The driver unit 2 and the diaphragm unit 3 thus combined with each other are stored in the case body 29 from above (see FIG. 19).

The diaphragm unit 3 stored in the case body 29 is positioned by both the front and rear end portions of the holding frame 18 that are placed on the installation stepped surfaces 29*a*, 29*a*, 29*a* of the case body 29 (see FIG. 3). At that time, a predetermined gap is formed between the lower surface of the driver unit 2 and the upper surface of the bottom surface portion of the case body 29.

Figure 20:
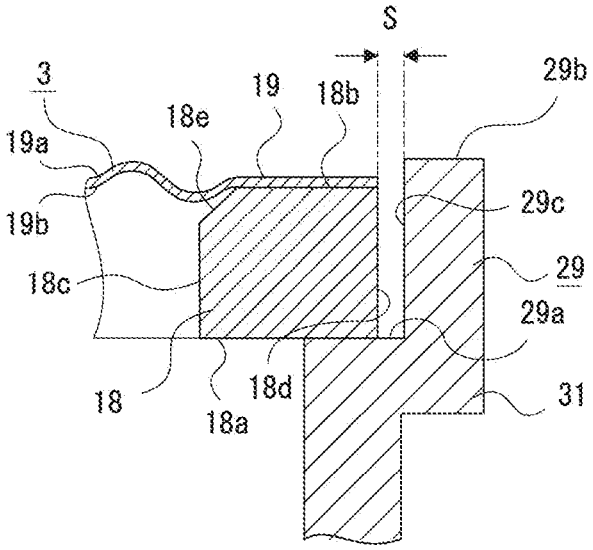
FIG. 20 is an enlarged cross-sectional view of the diaphragm unit and a case body of the acoustic converter.

In the state where the driver unit 2 and the diaphragm unit 3 are stored in the case body 29, the film bonding surface 18*b* of the holding frame 18 is located slightly downward on the immediately inner side of an upper end surface 29*b* of the case body 29 (see FIG. 20). At that time, a clearance S is formed between an outer surface 18*d* of the holding frame 18 and an inner surface 29*c* of the case body 29.

Further, in the state where the driver unit 2 and the diaphragm unit 3 are stored in the case body 29, the connection terminals 8, 8 partially protrude backward from the insertion notch 31*a* of the case body 29 (see FIG. 3 and FIG. 19).

Figure 21:
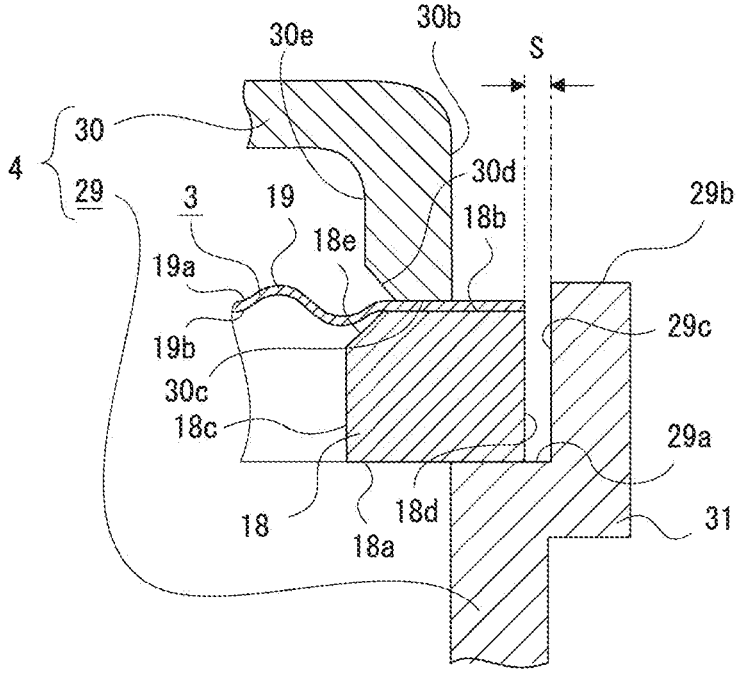
FIG. 21 is an enlarged cross-sectional view of the diaphragm unit, the case body, and a cover body of the acoustic converter.

The cover body 30 is placed on the outer circumference portion of the second film surface 19*a* of the film 19 (see FIG. 21).

Figure 22:
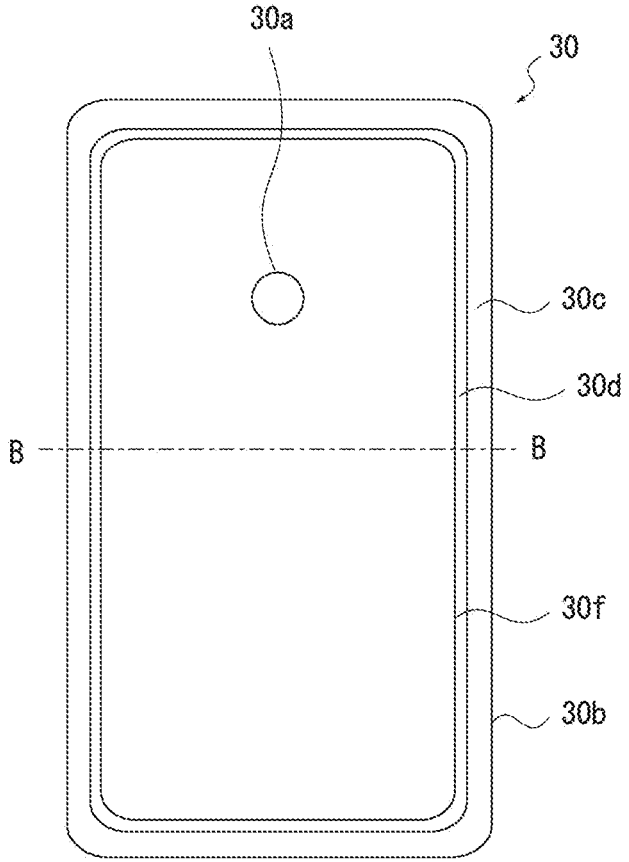
FIG. 22 is an enlarged cross-sectional view of the cover body of the acoustic converter.
Figure 23:
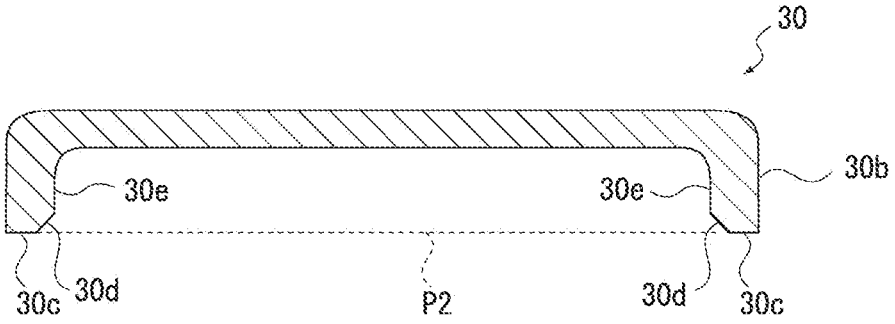
FIG. 23 is a cross-sectional view of the cover body of the acoustic converter.

FIG. 22 is a plan view of the cover body 30 when viewed from the diaphragm 20 side. FIG. 23 is a cross-sectional view of the cover body 30 taken along the line B-B of FIG. 22. As shown in those figures, the cover body 30 includes a film abutting surface 30*c* that abuts on the second film surface 19*a* of the film 19. Assuming that a virtual plane along the film abutting surface 30*c* is a second plane P2, the second plane P2 is a plane parallel to the first plane P1 (see FIG. 9). A chamfered portion 30*d* is provided to the circumference of the film abutting surface 30*c* on the inner surface 30*e* side.

Figure 24:
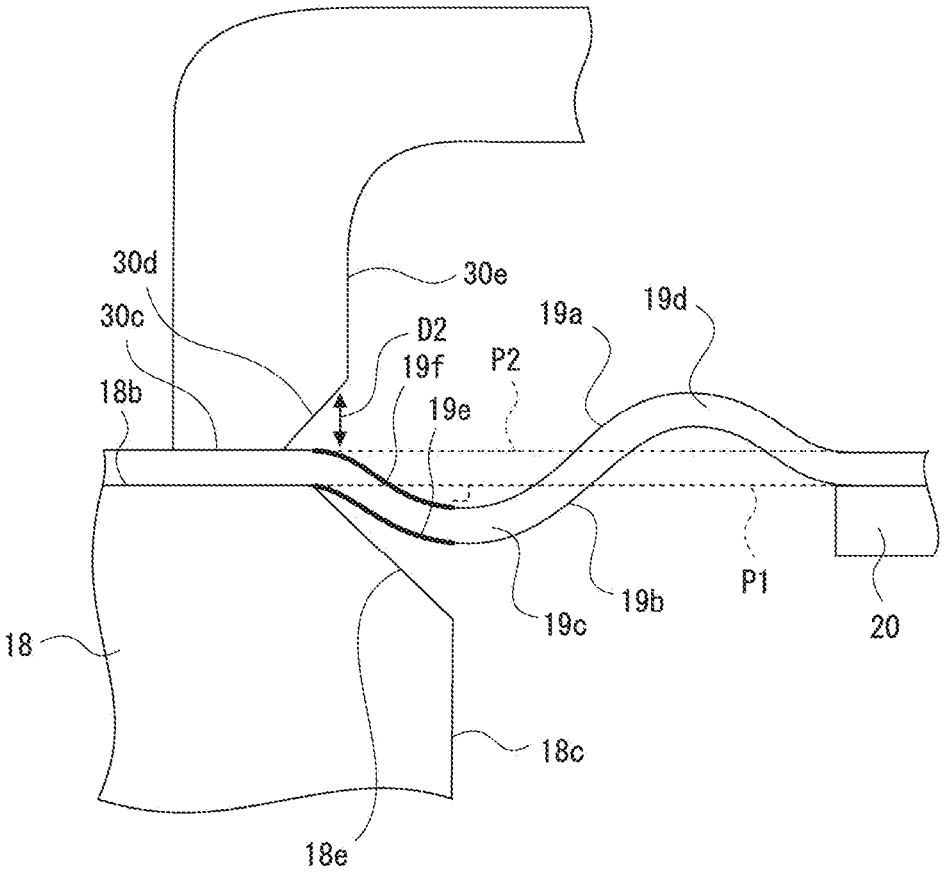
FIG. 24 is a schematic view of the diaphragm unit and the cover body of the acoustic converter.

FIG. 24 is a schematic view of the chamfered portion 30*d*. As shown in the figure, the chamfered portion 30*d* is a portion where the corner between the film abutting surface 30*c* and the inner surface 30*e* is chamfered. In the second film surface 19*a* of the film 19, the region on the back side of the unbonded region 19*e* is assumed as a back surface region 19*f*. The chamfered portion 30*d* is recessed relative to the second plane P2 and separates the back surface region 19*f* from the cover body 30 in a direction perpendicular to the second plane P2 (in the figure, the arrow D2).

As shown in FIG. 22, the chamfered portion 30*d* can be formed over the entire circumference of the film abutting surface 30*c*. Note that, as will be described later, depending on the joint state of the diaphragm 20 and the holding frame 18, the chamfered portion 30*d* does not need to be formed over the entire circumference of the film abutting surface 30*c*.

A specific shape of the chamfered portion 30*d* can be, as shown in FIG. 24, an inclined surface that is inclined with respect to the second plane P2 from the film abutting surface 30*c* toward the inner surface 30*e* so as to be gradually separated from the second plane P2.

Further, the chamfered portion 30*d* is not limited to the shape as described above and only needs to have a structure recessed relative to the second plane P2 and making the back surface region 19*f* separated from the cover body 30. Note that if the chamfered portion 30*d* is not provided and the cover body 30 does not abut on the back surface region 19*f*, the chamfered portion 30*d* does not have to be provided.

Figure 25:
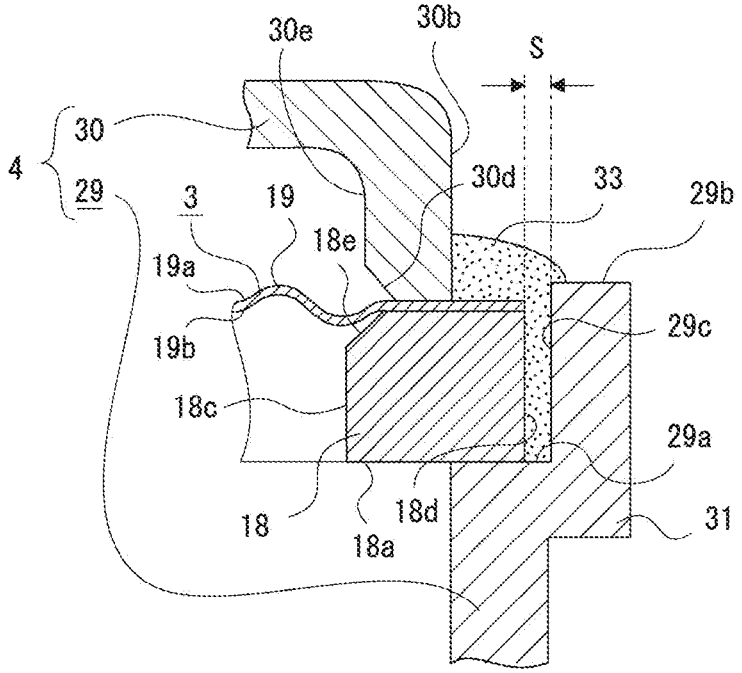
FIG. 25 is an enlarged cross-sectional view of the diaphragm unit, the case body, and the cover body of the acoustic converter.

In the state where the cover body 30 is placed on the second film surface 19*a*, a first sealing agent 33 is charged on the outer surface side of the cover body 30 (see FIG. 25). The first sealing agent 33 also has a bonding action. The first sealing agent 33 enters a gap between the outer surface 18*d* of the holding frame 18 and the inner surface 29*c* of the case body 29 and between an outer surface 30*b* of the cover body 30 and the inner surface 29*c* of the case body 29, and thus the clearance S is sealed and the cover body 30 is fixed to the case body 29.

Further, a second sealing agent (adhesive agent) 34 is applied in a clearance between the opening edge of the insertion notch 31*a* of the case body 29 and the connection terminals 8, 8, and sealing and bonding are performed (see FIG. 3).

As described above, in the acoustic converter 1, since the driver unit 2 and the diaphragm unit 3 are stored in the storage unit 4 including the case body 29 and the cover body 30 and having the sound output hole 30*a*, the driver unit 2 and the diaphragm unit 3 are protected by the storage unit 4 and can be prevented from being damaged or broken.

<Regarding Operation of Acoustic Converter>

In the acoustic converter 1, when a current is supplied to the coil 7, the vibrating portion 16 of the armature 9 located between the pair of magnets 6, 6 is magnetized, and the polarity of the vibrating portion 16 is repeatedly changed at a position facing the magnets 6, 6. Minute vibration is generated at the vibrating portion 16 by the repeatedly changed polarity, the generated vibration is transmitted from the transmission beam 21 to the diaphragm 20, and the transmitted vibration is amplified at the diaphragm 20, converted into sound, and output from the sound output hole 30*a* of the cover body 30.

At that time, in order to achieve improvement in acoustic properties by suppressing variation in sound pressure in the frequency region of the output sound, it is necessary to secure an optimal vibration state of the diaphragm 20. In particular, in order to achieve improvement in acoustic properties in a low frequency region, it is desirable that the diaphragm 20 is displaced in the thickness direction to perform a translational motion.

As described above, the acoustic converter 1 is configured such that the distance M is formed between the entire outer circumference of the diaphragm 20 and the entire inner circumference of the holding frame 18.

Figure 26:
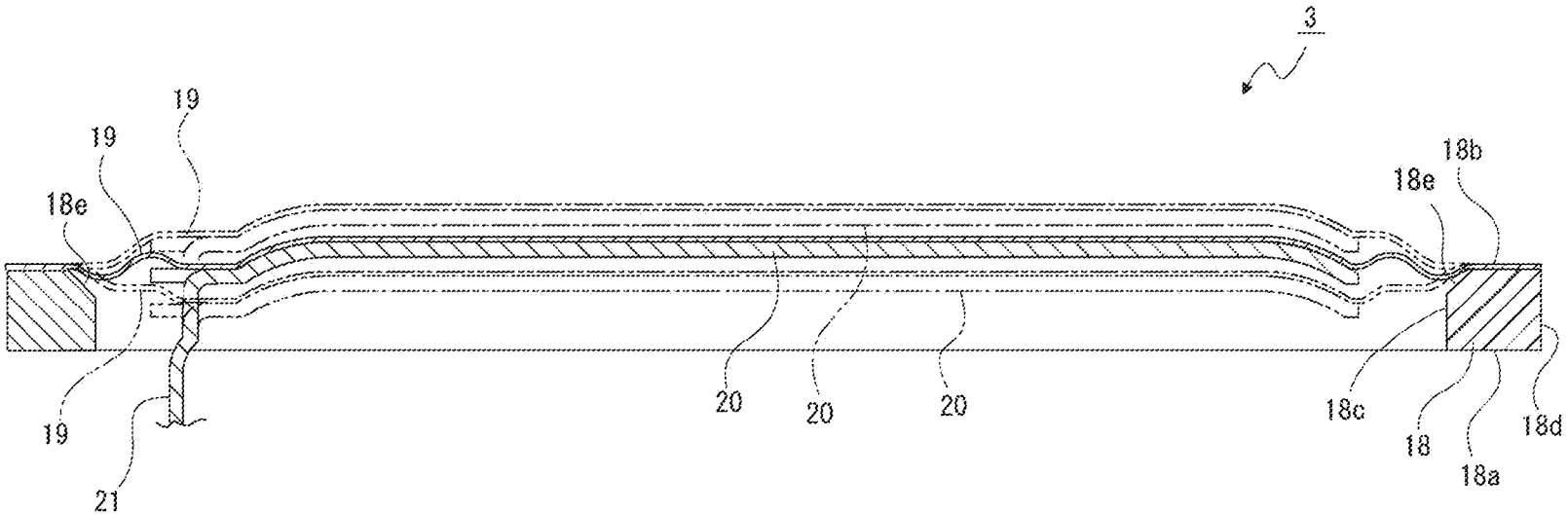
FIG. 26 is a schematic view showing a vibrating state of the diaphragm of the diaphragm unit of the acoustic converter.

Therefore, the diaphragm 20 is held by the film 19 inward relative to the inner circumference of the holding frame 18, and when the vibration is transmitted from the vibrating portion 16 to the diaphragm 20 via the transmission beam 21, the translational motion of the diaphragm 20 occurs in the thickness direction (see FIG. 26).

Figure 27:
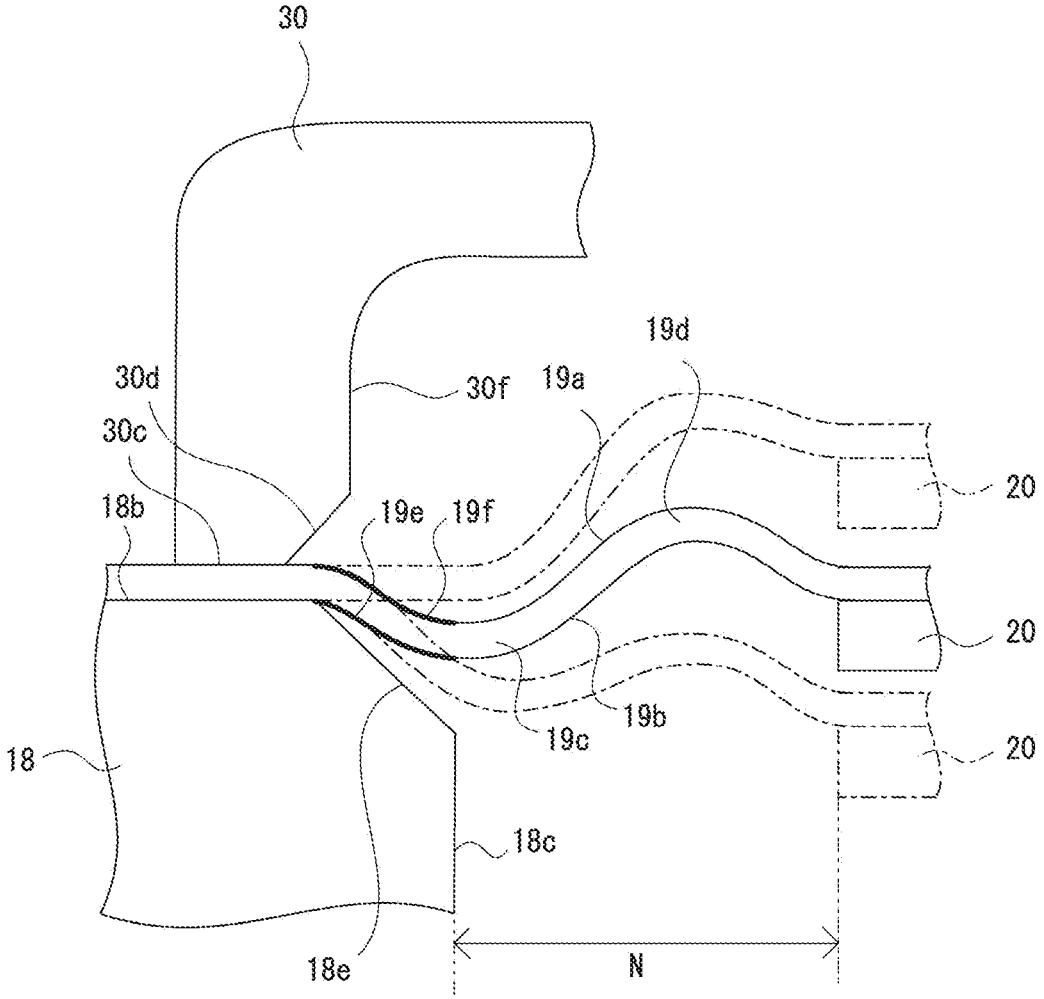
FIG. 27 is a schematic view showing a vibrating state of the diaphragm of the diaphragm unit of the acoustic converter.

FIG. 27 is a schematic view showing the motion of the film 19 when the diaphragm 20 vibrates. As described above, the film 19 includes the unbonded region 19*e*. Accordingly, a variable area of the film 19 (area of the film 19 between the film bonding surface 18*b* and the diaphragm 20) can be enlarged without increasing a clearance (in the figure, N) between the holding frame 18 and the diaphragm 20. In other words, compared to the case where the unbonded region 19*e* is not provided, the area of the diaphragm 20 can be enlarged while the variable area of the film 19 is maintained, and the sound pressure of the sound generated by the acoustic converter 1 can be improved.

Narrowing the width of the holding frame 18 also enables the variable area of the film 19 to be enlarged. However, the holding frame 18 is a press worked product, which is difficult to process thinly. In this regard, with the chamfered portion 18*e*, the variable area of the film 19 can be enlarged without reducing the width of the holding frame 18.

For example, in the case where the clearance between the holding frame 18 and the diaphragm 20 needs 0.35 mm, if the width of the chamfered portion 18*e* is set to be 0.1 mm, the clearance of 0.35 mm can be secured and the area of the diaphragm 20 can also be enlarged. Accordingly, the width of the diaphragm 20 can be set from 1.5 mm to 1.7 mm, the area of the diaphragm 20 is increased by 14%, and the sound pressure can be improved by 1 dB.

The chamfered portion 18*e* causes the holding frame 18 and the film 19 to be separated from each other, to form the unbonded region 19*e*, and prevents the vibrating film 19 from coming into contact with the holding frame 18. Further, the chamfered portion 30*d* provided to the cover body 30 also prevents the vibrating film 19 from coming into contact with the cover body 30.

Further, the film 19 is curved between the film bonding surface 18*b* and the diaphragm 20 such that the cross-section of the film 19 has an S-shape, and the variable range of the film 19 is increased compared to the case of the film 19 having no curves. Therefore, the amplitude of the diaphragm 20 can be increased. Also in this respect, the sound pressure of the sound generated by the acoustic converter 1 can be improved.

<Method of Forming Film Shape>

Figure 28:
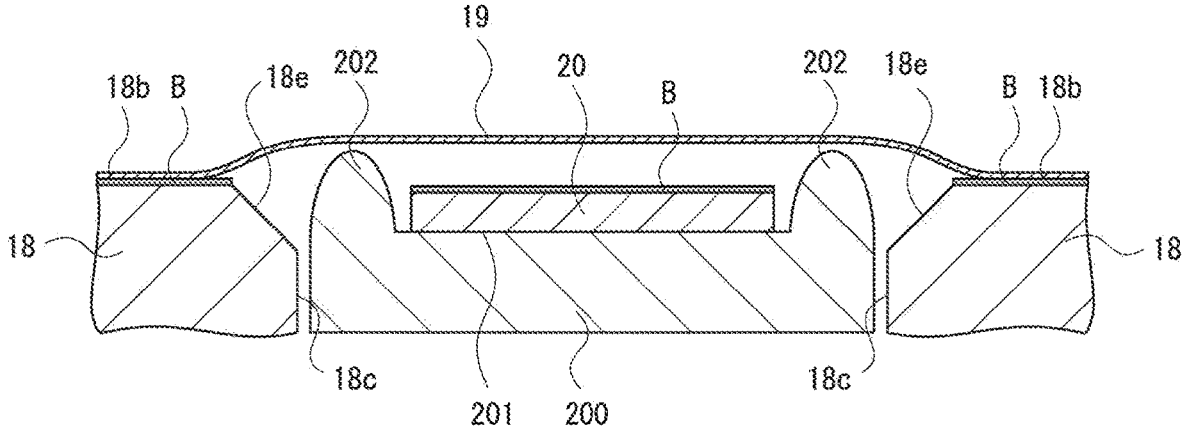
FIG. 28 is a schematic view showing a method of forming a film shape of the diaphragm unit of the acoustic converter.
Figure 29:
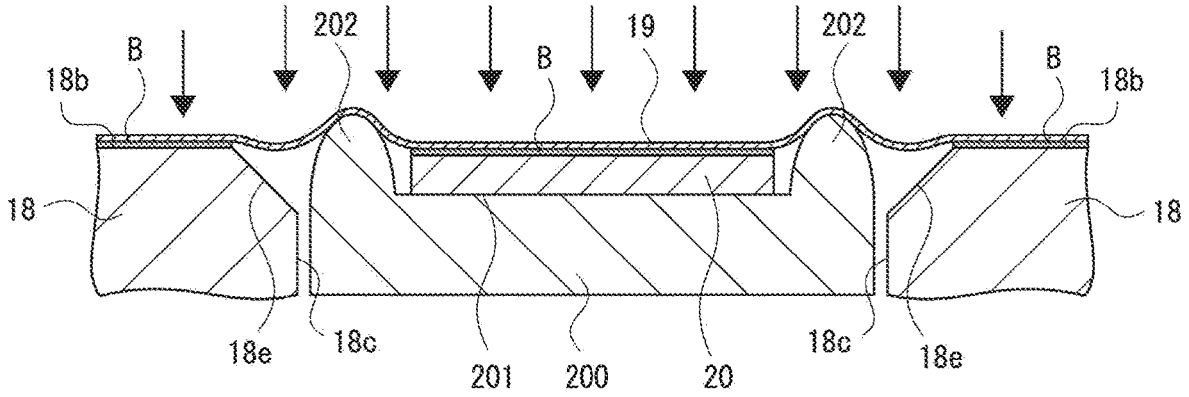
FIG. 29 is a schematic view showing the method of forming the film shape of the diaphragm unit of the acoustic converter.
Figure 30:
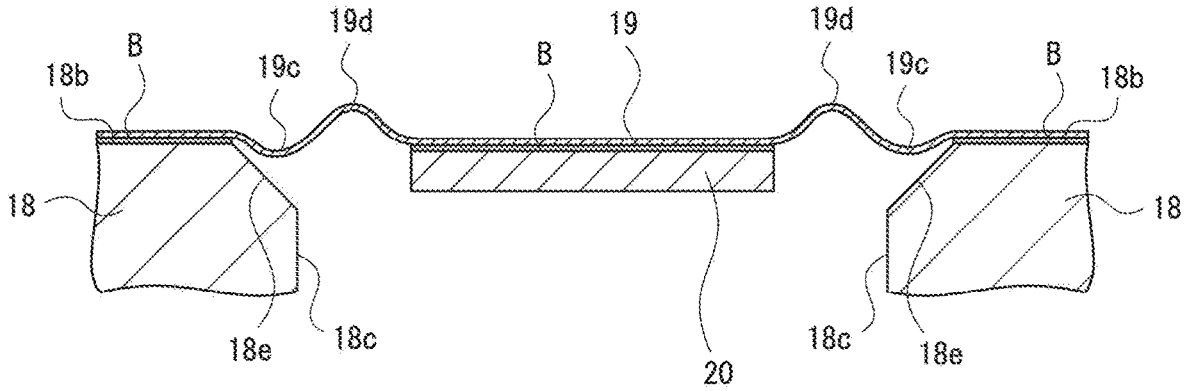
FIG. 30 is a schematic view showing the method of forming the film shape of the diaphragm unit of the acoustic converter.
Figure 31:
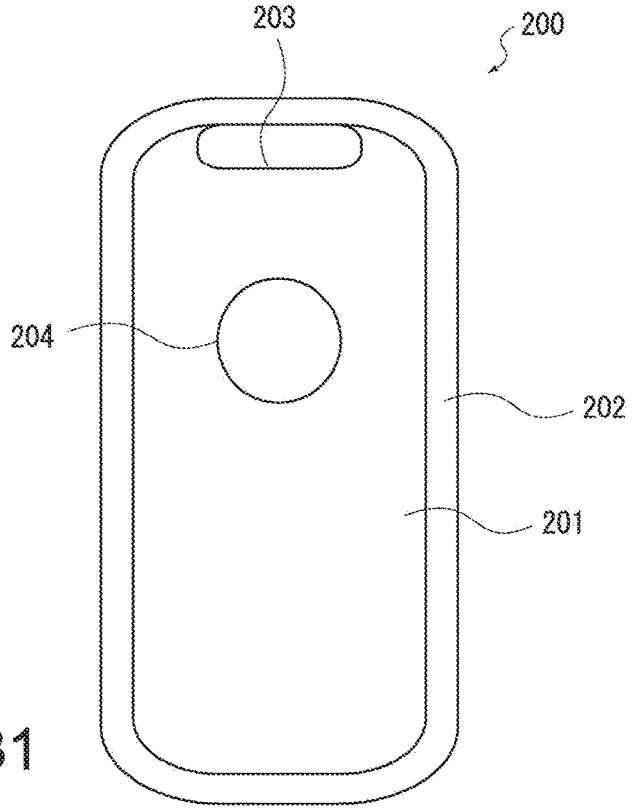
FIG. 31 is a plan view of a mold used for forming the film shape of the diaphragm unit of the acoustic converter.

FIG. 28 to FIG. 30 are schematic views each showing a method of forming the shape of the film 19. As shown in FIG. 28, a mold 200 is disposed within the opening 18*c* of the holding frame 18. FIG. 31 is a plan view of the mold 200. As shown in FIG. 28 and FIG. 31, the mold 200 includes an installation surface 201, a convex portion 202, an opening 203, and an opening 204.

Figure 32:
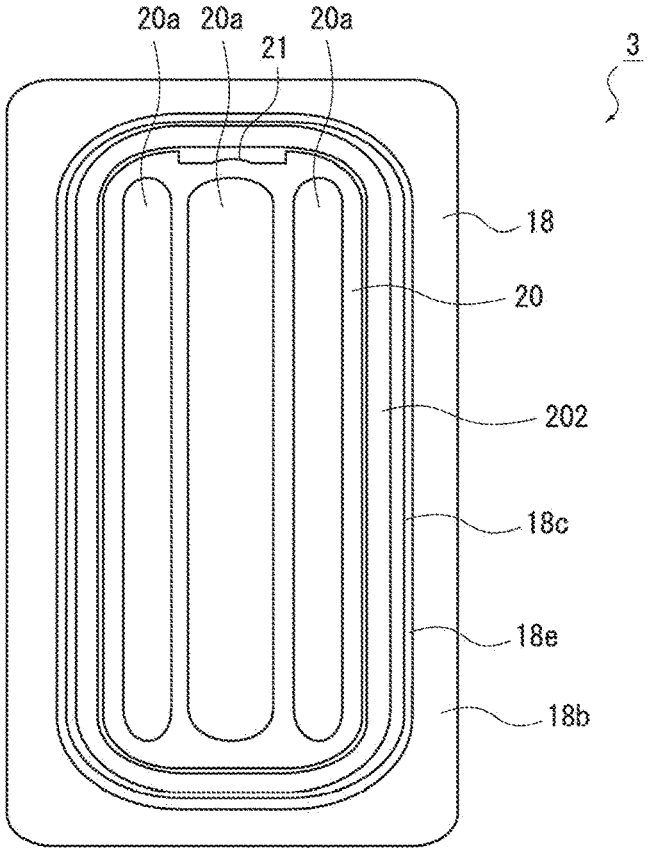
FIG. 32 is a plan view of the mold used for forming the film shape of the diaphragm unit and the diaphragm unit of the acoustic converter.

As shown in FIG. 28, the diaphragm 20 is placed on the installation surface 201. The transmission beam 21 (see FIG. 17) is inserted into the opening 203. FIG. 32 is a plan view of a state where the mold 200 is placed on the installation surface 201. As shown in FIG. 28 and FIG. 32, the convex portion 202 protrudes between the diaphragm 20 and the holding frame 18, from the film bonding surface 18*b* and the diaphragm 20. The adhesive agent B is disposed in advance on the upper surfaces of the film bonding surface 18*b* and the diaphragm 20. Furthermore, a film 19 that is not yet molded is disposed on the holding frame 18 and the diaphragm 20.

Subsequently, as shown in FIG. 29, the film 19 is pressed to the diaphragm 20 and the holding frame 18 by compressed air (in the figure, the arrows). Accordingly, the film 19 abuts on the convex portion 202 and is then deformed such that the cross-section has an S-shape. Simultaneously, the film 19 is bonded to the film bonding surface 18*b* and the diaphragm 20 by the adhesive agent B disposed on the film bonding surface 18*b* and the diaphragm 20, and the unbonded region 19*e* (see FIG. 15) is formed by the chamfered portion 18*e*.

Subsequently, the mold 200 is removed as shown in FIG. 30. The mold 200 can be removed by pushing up the diaphragm 20 through the opening 204. As described above, the shape of the film 19 is formed. Note that the film 19 does not need to be pressed by compressed air. For example, the mold 200 side of the film 19 may be decompressed.

Modified Example

Figure 33:
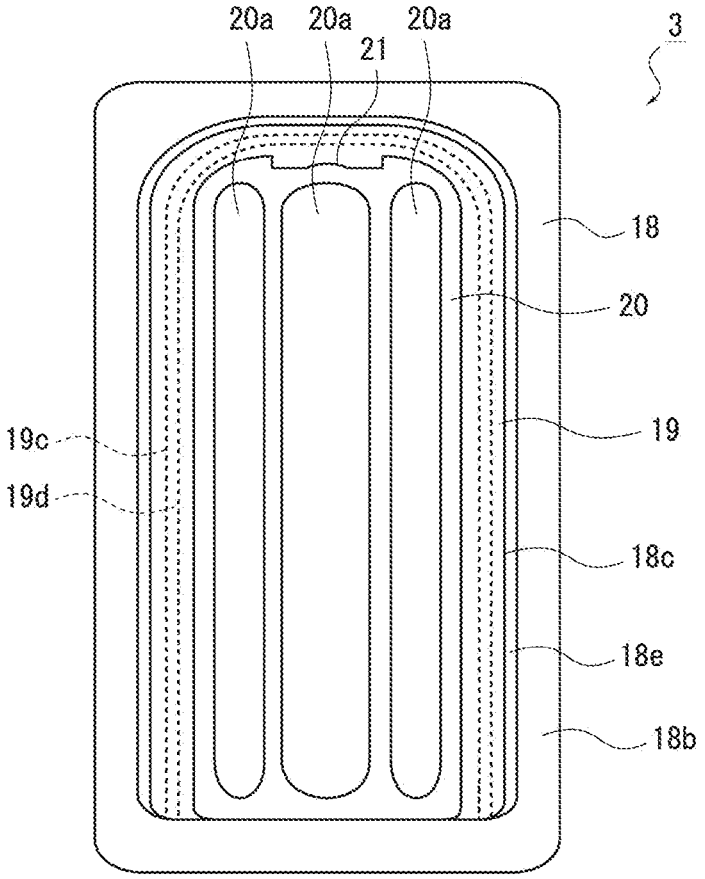
FIG. 33 is a plan view of a diaphragm unit of an acoustic converter according to a modified example of this embodiment.

FIG. 33 is a plan view of the diaphragm unit 3 according to a modified example of this embodiment. Note that FIG. 33 shows the film 19 in a transparent manner. As shown in the figure, in the circumference of the diaphragm 20, a side on the opposite side to the transmission beam 21 may be joined to the holding frame 18. Note that other configurations are the same as those described above, in which the unbonded region 19*e* and the chamfered portion 18*e* are provided except the side described above.

The diaphragm 20 and the holding frame 18 can be joined by an adhesive agent. Since the film 19 does not vibrate between the side joined to the diaphragm 20 in the inner circumference of the holding frame 18 and the diaphragm 20, the above-mentioned side may not be provided with the chamfered portion 18*e*. With this configuration as well, the area of the diaphragm 20 can be enlarged, and the sound pressure of the sound generated by the acoustic converter 1 can be improved.

<Sound Output Device>

In the acoustic converter 1, the distance M is formed over the entire circumference between the diaphragm 20 and the holding frame 18 to cause the diaphragm 20 to perform a translational motion, which enables the diaphragm 20 to perform a translational motion without increasing the amplitude of the vibrating portion 16 or increasing the area of the diaphragm 20. Therefore, it is possible to achieve improvement in acoustic properties, particularly, improvement in acoustic properties in the low frequency region without increasing the production cost and the size. Meanwhile, in the acoustic converter 1, there is a possibility that a sufficient sensitivity is not secured in the high frequency region.

Figure 34:
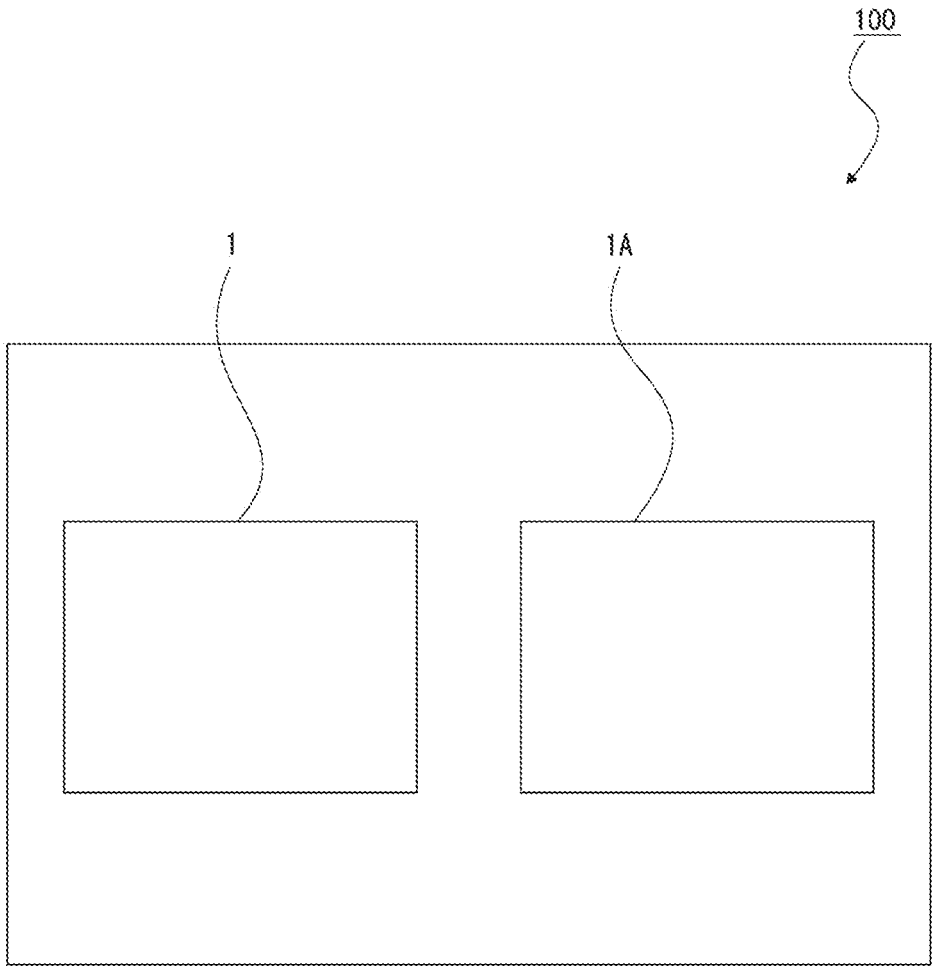
FIG. 34 is a schematic view of a sound output device according to an embodiment of the present technology.

In this case, for example, in addition to the acoustic converter 1, an acoustic converter 1A for high-pitched sound that can secure high acoustic properties in the high frequency region may be integrated into a sound output device 100 such as headphones, earphones, or hearing aids to be used (see FIG. 34). The acoustic converter 1 is used as a first acoustic converter, and the acoustic converter 1A is used as a second acoustic converter. Note that the acoustic converter 1A may be used as a device corresponding to the full range.

Figure 35:
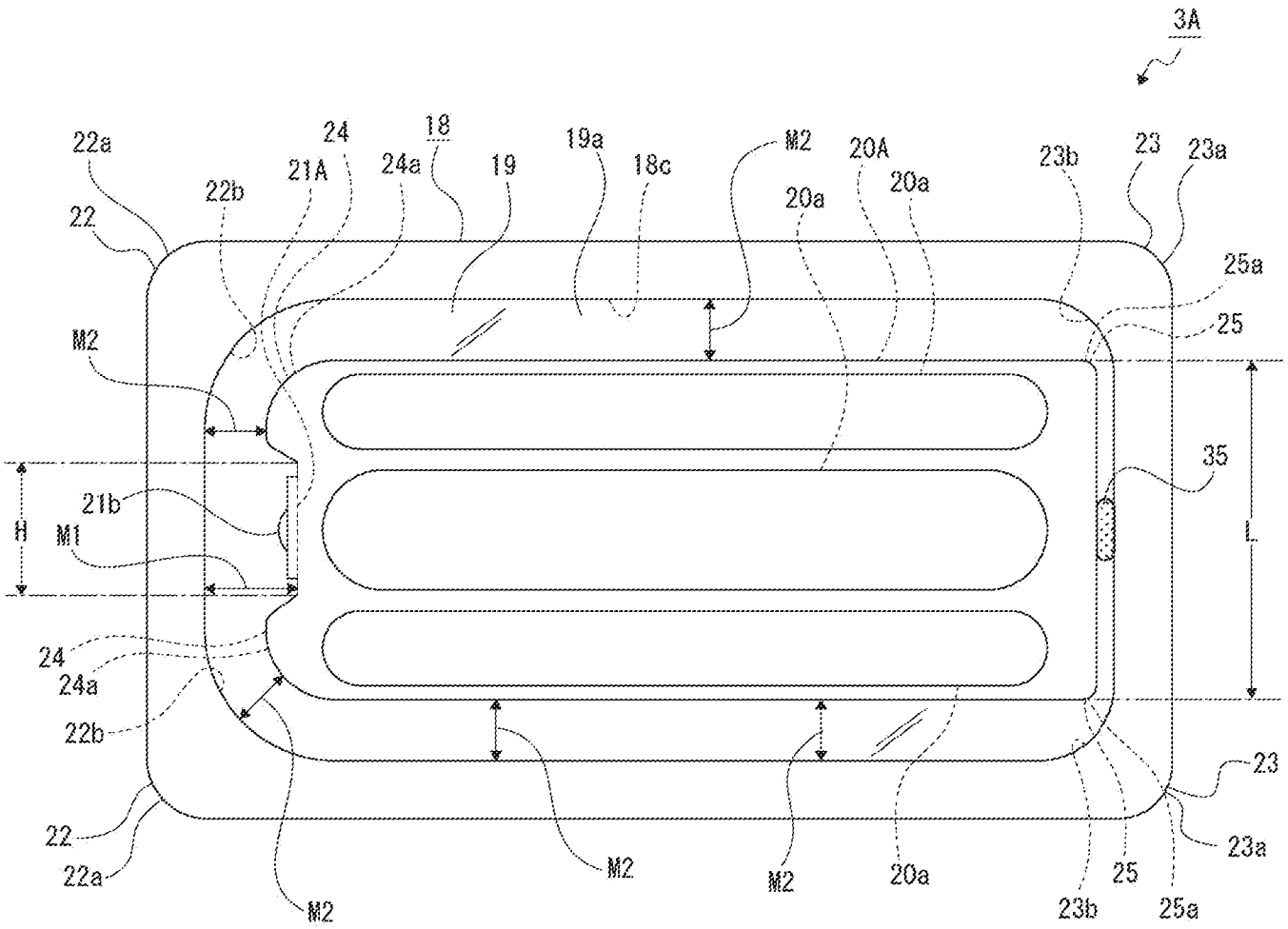
FIG. 35 is a plan view of a diaphragm unit of a second acoustic converter of the sound output device.
Figure 36:
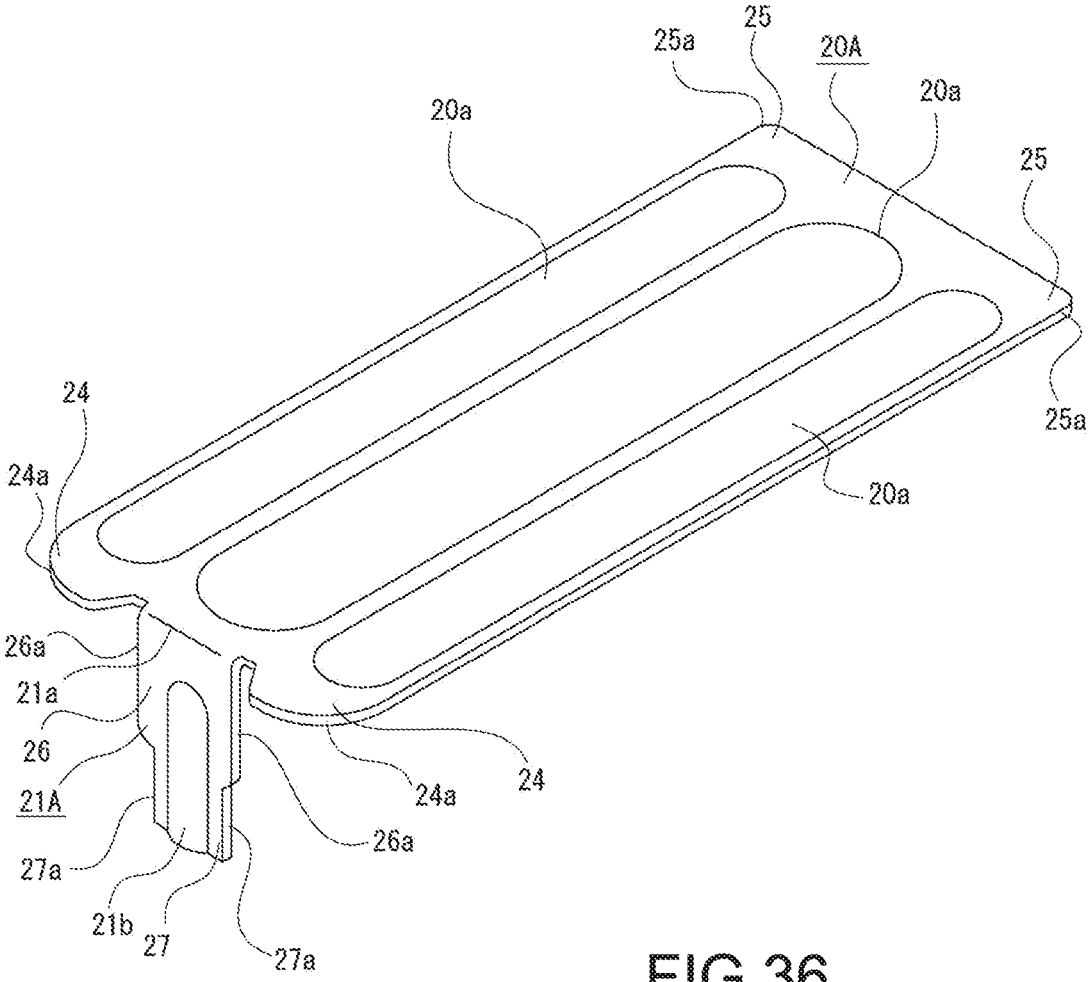
FIG. 36 is a perspective view of the diaphragm unit of the second acoustic converter of the sound output device.

The acoustic converter 1A includes, for example, a driver unit 2, a diaphragm unit 3A, and a storage unit 4. In the diaphragm unit 3A, as shown in the modified example described above, a side of the diaphragm 20 can be joined to the holding frame 18 (see FIG. 35 and FIG. 36). Note that in the acoustic converter 1A the diaphragm unit 3A is different from the diaphragm unit 3A in a part of the configuration, and thus the following acoustic converter 1A will be described in detail on the different configuration only.

The diaphragm unit 3A includes a holding frame 18, a film 19, a diaphragm 20A, and a transmission beam 21A.

When compared to the diaphragm 20, the diaphragm 20A has the same width in the horizontal direction but a larger length in the front-back direction, and has a reduced thickness TA. The diaphragm 20 is set to have the thickness TA of, for example, approximately 30 μm and is thinner than the thickness T of the diaphragm 20.

The rear end portion of the diaphragm 20A is fixed to the inner circumferential portion of the holding frame 18 by an adhesive agent 35 for fixation.

The transmission beam 21A is formed integrally with the diaphragm 20A and, for example, formed by being bent downward from the diaphragm 20A. A bent portion 21*a* of the transmission beam 21A, which is formed by being bent from the diaphragm 20A, has a width HA in the horizontal direction, which is set to, for example, approximately 0.7 mm and is smaller than the width H of the bent portion 21*a* of the transmission beam 21.

Note that the transmission beam 21A may also be formed of, for example, a round-shaft-shaped metal column.

In the acoustic converter 1A, when a current is supplied to the coil 7 and the vibrating portion 16 vibrates, the vibration of the vibrating portion 16 is transmitted from the transmission beam 21A to the diaphragm 20A, the diaphragm 20A vibrates, and sound corresponding to the vibration of the diaphragm 20A is output. At that time, since one end portion of the diaphragm 20A is fixed to the inner circumferential portion of the holding frame 18, the diaphragm 20A vibrates in a cantilever state with the bonded portion being as a fulcrum. In such a manner, the diaphragm 20A vibrates with the bonded portion being as a fulcrum, and thus variations in sound pressure in the high frequency region is particularly suppressed, so that a stable sound pressure can be obtained.

Therefore, with the acoustic converter 1 including the diaphragm 20 whose entire outer circumference is isolated from the entire inner circumference of the holding frame 18, and the acoustic converter 1A including the diaphragm 20A whose one end portion is fixed to the inner circumferential portion of the holding frame 18, improvement in acoustic properties can be achieved in the entire output region of sound in the low frequency region and the high frequency region, without causing the increase in production cost and size.

Further, since the width H of the bent portion 21*a* of the transmission beam 21 in the acoustic converter 1 is larger than the width HA of the bent portion 21A of the transmission beam 21A in the acoustic converter 1A, the strength of the transmission beam 21 is higher than that of the transmission beam 21A.

Therefore, the transmission beam 21 and the transmission beam 21A are formed to have strengths suitable for the low frequency region and the high frequency region, respectively, and further improvement in acoustic properties can be achieved in the entire output region of sound in the low frequency region and the high frequency region.

Furthermore, since the thickness T of the diaphragm 20 in the acoustic converter 1 is thicker than the thickness of the diaphragm 20A in the acoustic converter 1A, the strength of the diaphragm 20 is higher than that of the diaphragm 20A.

Therefore, the diaphragm 20 and the diaphragm 20A are formed to have strengths suitable for the low frequency region and the high frequency region, respectively, and further improvement in acoustic properties can be achieved in the entire output region of sound in the low frequency region and the high frequency region.

Note that the sound output device 100 is formed by using the acoustic converter 1 and the acoustic converter 1A, and thus common parts can be used for the acoustic converter 1 and the acoustic converter 1A except the diaphragm units 3, 3A, because the acoustic converter 1A includes the diaphragm unit 3A that is different from the diaphragm unit 3A in only a part of the configuration thereof.

Therefore, it is possible to facilitate the designing of the sound output device 100 and reduce the production cost.

Note that a low-pass filter is integrated into the acoustic converter 1, and a high-pass filter is integrated into the acoustic converter 1A, so that it is possible to suppress overlap of the high-pitched sound and the low-pitched sound and secure optimal acoustic properties in each of the low frequency region and the high frequency region. Further, the sound output device 100 may include only one of the acoustic converter 1 and the acoustic converter 1A.

Note that the present technology can also have the following configurations.

(1)

An acoustic converter, including:

a driver unit including a magnet, a coil to which a driving current is supplied, and an armature including a vibrating portion that vibrates when the driving current is supplied to the coil; and a diaphragm unit including a holding frame that has an opening, a film that is bonded to a film bonding surface as one surface of the holding frame with the opening being covered with the film, a diaphragm that is held on an inner side of the holding frame while being bonded to the film, and a transmission beam that transmits vibration of the vibrating portion to the diaphragm, the film bonding surface being located on a first plane, the film having a first film surface and a second film surface on the opposite side to the first film surface, the film bonding surface and the diaphragm being bonded to the first film surface, the first film surface including an unbonded region that faces the holding frame in a direction perpendicular to the first plane between the film bonding surface and the diaphragm and is not bonded to the holding frame.

(2)

The acoustic converter according to (1), in which the holding frame includes a first chamfered portion, the first chamfered portion being recessed relative to the first plane in a circumference of the opening located in the first plane, separating the first film surface from the holding frame, and forming the unbonded region.

(3)

The acoustic converter according to (1) or (2), in which the film is curved between the film bonding surface and the diaphragm such that a cross-section of the film has an S-shape.

(4)

The acoustic converter according to (3), in which the film includes a first curved portion and a second curved portion, the first curved portion protruding toward the first film surface relative to the first plane and being adjacent to the film bonding surface, the second curved portion protruding toward the second film surface relative to the first plane and being adjacent to the first curved portion and the diaphragm, and the first chamfered portion separates the first curved portion and the holding frame from each other.

(5)

The acoustic converter according to any one of (1) to (4), further including a cover body that is joined to the holding frame via the film and surrounds the diaphragm, and includes a film abutting surface that abuts on the second film surface, in which the film abutting surface is located on a second plane parallel to the first plane, and the cover body includes a second chamfered portion, the second chamfered portion being recessed relative to the second plane in a circumference of the cover body and separating a back side region of the unbonded region in the second film surface from the cover body.

(6)

The acoustic converter according to any one of (2) to (5), in which a part of a circumference of the diaphragm is joined to the holding frame, and the first chamfered portion is provided to a portion of the circumference of the opening, the portion being separated from the diaphragm.

(7)

The acoustic converter according to any one of (2) to (5), in which the entire circumference of the diaphragm is separated from the holding frame, and the first chamfered portion is provided to the entire circumference of the opening.

(8)

A sound output device, including an acoustic converter including a driver unit including a magnet, a coil to which a driving current is supplied, and an armature including a vibrating portion that vibrates when the driving current is supplied to the coil, and a diaphragm unit including a holding frame that has an opening, a film that is bonded to a film bonding surface as one surface of the holding frame with the opening being covered with the film, a diaphragm that is held on an inner side of the holding frame while being bonded to the film, and a transmission beam that transmits vibration of the vibrating portion to the diaphragm, the film bonding surface being located on a first plane, the film having a first film surface and a second film surface on the opposite side to the first film surface, the film bonding surface and the diaphragm being bonded to the first film surface, the first film surface including an unbonded region that faces the holding frame in a direction perpendicular to the first plane between the film bonding surface and the diaphragm and is not bonded to the holding frame.

REFERENCE SIGNS LIST

1 acoustic converter
2 driver unit
2 diaphragm unit
4 storage unit
5 yoke
6 magnet
7 coil
9 armature
16 vibrating portion
18 holding frame
18*c* opening
19 film
20 diaphragm
20*a* reinforcing rib
21 transmission beam
21*a* bent portion
21*b* rib
22 corner portion
22*b* inner circumference
23 corner portion
23*b* inner circumference
24 corner portion
24*a* outer circumference
25 corner portion
25*a* outer circumference
26 base portion
27 coupling portion
29 case body
30 cover body
30*a* sound output hole
1A acoustic converter
3A diaphragm unit
20A diaphragm
21A transmission beam
sound output device 100

The invention claimed is:

1. An acoustic converter, comprising:

a driver unit that includes:

a magnet, a coil to which a driving current is supplied, and an armature that includes a vibrating portion configured to vibrate based on the supplied driving current; and a diaphragm unit that includes:

a holding frame that includes:

an opening in a first plane, and a first chamfered portion, wherein the first chamfered portion is recessed relative to the first plane in a circumference of the opening, a film that is bonded to a film bonding surface as one surface of the holding frame, wherein the film covers the opening, a diaphragm on an inner side of the holding frame, wherein the diaphragm is bonded to the film, and a transmission beam configured to transmit vibration of the vibrating portion to the diaphragm, wherein the film bonding surface is on the first plane, the film includes a first film surface and a second film surface;

the second film surface is on an opposite side to the first film surface, the film bonding surface and the diaphragm are bonded to the first film surface, the first film surface includes an unbonded region that faces the holding frame in a direction perpendicular to the first plane, the first plane is between the film bonding surface and the diaphragm, the unbonded region is not bonded to the holding frame, and the first chamfered portion separates the first film surface from the holding frame and forms the unbonded region.

2. The acoustic converter according to claim 1, wherein the film is curved between the film bonding surface and the diaphragm, and a cross-section of the film includes an S-shape.

3. The acoustic converter according to claim 2, wherein the film includes a first curved portion and a second curved portion, the first curved portion protrudes toward the first film surface relative to the first plane, the first curved portion is adjacent to the film bonding surface, the second curved portion protrudes toward the second film surface relative to the first plane, the second curved portion is adjacent to the first curved portion and the diaphragm, and the first chamfered portion separates the first curved portion from the holding frame.

4. The acoustic converter according to claim 1, further comprising a cover body that is joined to the holding frame via the film, wherein the cover body surrounds the diaphragm, the cover body includes a film abutting surface that abuts on the second film surface, the film abutting surface is on a second plane parallel to the first plane, the cover body includes a second chamfered portion, the second chamfered portion is recessed relative to the second plane in a circumference of the cover body, and the second chamfered portion separates a back side region of the unbonded region in the second film surface from the cover body.

5. The acoustic converter according to claim 1, wherein a part of a circumference of the diaphragm is joined to the holding frame, the first chamfered portion is on a portion of the circumference of the opening, and the portion of the circumference is separate from the diaphragm.

6. The acoustic converter according to claim 1, wherein a circumference of the diaphragm is separated from the holding frame, and the first chamfered portion is on the circumference of the opening.

7. A sound output device, comprising an acoustic converter that includes:

a driver unit that includes:

a magnet, a coil to which a driving current is supplied, and an armature that includes a vibrating portion configured to vibrate based on the supplied driving current; and a diaphragm unit that includes:

a holding frame that includes:

an opening in a first plane, and a first chamfered portion, wherein the first chamfered portion is recessed relative to the first plane in a circumference of the opening, a film that is bonded to a film bonding surface as one surface of the holding frame, wherein the film covers the opening, a diaphragm on an inner side of the holding frame, wherein the diaphragm is bonded to the film, and a transmission beam configured to transmit vibration of the vibrating portion to the diaphragm, wherein the film bonding surface is on the first plane, the film includes a first film surface and a second film surface, the second film surface is on an opposite side to the first film surface, the film bonding surface and the diaphragm are bonded to the first film surface, the first film surface includes an unbonded region that faces the holding frame in a direction perpendicular to the first plane, the first plane is between the film bonding surface and the diaphragm, the unbonded region is not bonded to the holding frame, and the first chamfered portion separates the first film surface from the holding frame and forms the unbonded region.

* * * * *